US007092793B2

(12) United States Patent
Peterson et al.

(10) Patent No.: US 7,092,793 B2
(45) Date of Patent: Aug. 15, 2006

(54) METHOD AND SYSTEM FOR INSTALLATION AND CONTROL OF A UTILITY DEVICE

(75) Inventors: Jeff Peterson, Hudson, WI (US); Robert May, Lakeville, MN (US); Dan Flesher, Lake Elmo, MN (US); John Rolando, Woodbury, MN (US); Ed Sowle, Woodbury, MN (US); Steven Lentsch, St. Paul, MN (US); Ronald Howes, Jr., Minneapolis, MN (US)

(73) Assignee: Ecolab Inc, Mendota Heights, MN (US)

( * ) Notice: Subject to any disclaimer, the term of this patent is extended or adjusted under 35 U.S.C. 154(b) by 291 days.

(21) Appl. No.: 10/699,531

(22) Filed: Oct. 31, 2003

(65) Prior Publication Data

US 2005/0096788 A1 May 5, 2005

(51) Int. Cl.
*G05B 21/00* (2006.01)

(52) U.S. Cl. ..... 700/266; 700/265; 700/240; 8/159

(58) Field of Classification Search ..... 700/239–241, 700/231, 265–266; 134/56 R, 57 R, 57 D; 8/158–159
See application file for complete search history.

(56) References Cited

U.S. PATENT DOCUMENTS 3,774,056 A 11/1973 Sample et al.
4,194,242 A 3/1980 Robbins
4,241,400 A 12/1980 Kiefer
4,334,270 A 6/1982 Towers
4,482,785 A 11/1984 Finnegan et al.
4,509,543 A 4/1985 Livingston et al.
4,597,046 A 6/1986 Musmanno et al.
4,733,798 A 3/1988 Brady et al.
4,739,478 A 4/1988 Roberts et al.
4,756,321 A 7/1988 Livingston et al.
5,014,211 A 5/1991 Turner et al.
5,038,807 A 8/1991 Bailey et al.
5,043,860 A 8/1991 Koether et al.
5,203,366 A 4/1993 Czeck et al. ..... 137/3
5,222,027 A 6/1993 Williams et al. ..... 700/239
5,282,901 A * 2/1994 Reinhard ..... 134/18
5,345,379 A 9/1994 Brous et al. ..... 700/17

(Continued)

OTHER PUBLICATIONS

U.S. Appl. No. 09/692,550, filed Oct. 19, 2000, Howes, Jr. et al.*

(Continued)

*Primary Examiner*—Leo Picard
*Assistant Examiner*—Alexander Kosowski
(74) *Attorney, Agent, or Firm*—Shumaker & Sieffert PA

(57) ABSTRACT

A system and method is disclosed for configuring and administering control over operations of a utility device. The utility device is described herein as being a warewash machine, but other utility devices are contemplated. A warewash controller administers control over operations of the warewash machine based on operational settings defined by the process disclosed herein. The operational settings are derived based on environmental parameters (e.g., water type, soil level, selected chemical product, etc.) specified by a field service person through a graphical user interface. If an environmental parameter is changed during the operational life cycle of the warewash machine, the operational settings are modified to accommodate for such a change. Thus, the service performed by the warewash machine is maintained at a consistent quality regardless of changes in the environment. A method for selecting the specific chemical product that will be input as an environmental parameter is also disclosed.

22 Claims, 9 Drawing Sheets

U.S. PATENT DOCUMENTS 5,370,267 A 12/1994 Schroeder
5,397,028 A 3/1995 Jesadanont
5,404,893 A 4/1995 Brady et al.
5,448,115 A * 9/1995 Howland et al. ..... 307/118
5,491,791 A 2/1996 Glowney et al.
5,556,478 A 9/1996 Brady et al.
5,625,659 A 4/1997 Sears
5,625,908 A 5/1997 Shaw
5,681,400 A * 10/1997 Brady et al. ..... 134/18
5,694,323 A 12/1997 Koropitzer et al. ..... 705/400
5,695,091 A 12/1997 Winings et al.
5,724,261 A 3/1998 Denny et al.
5,745,381 A 4/1998 Tanaka et al. ..... 702/182
5,757,664 A 5/1998 Rogers et al. ..... 700/232
5,810,201 A 9/1998 Besse et al.
5,826,749 A 10/1998 Howland et al. ..... 222/1
5,839,097 A 11/1998 Klausner ..... 340/825.69
5,875,430 A 2/1999 Koether
5,905,648 A * 5/1999 Badami ..... 700/55
5,939,974 A * 8/1999 Heagle et al.
5,945,910 A 8/1999 Gorra
5,956,487 A 9/1999 Venkatraman et al.
5,967,202 A 10/1999 Mullen et al. ..... 141/104
5,973,696 A * 10/1999 Agranat et al.
5,975,352 A 11/1999 Spriggs et al. ..... 222/23
5,980,090 A 11/1999 Royal et al. ..... 700/241
6,003,070 A * 12/1999 Frantz
6,061,668 A 5/2000 Sharrow ..... 705/400
6,133,555 A * 10/2000 Brenn
6,133,847 A * 10/2000 Yang
6,321,204 B1 11/2001 Kazami et al. ..... 705/7
6,330,499 B1 * 12/2001 Chou et al.
6,356,205 B1 * 3/2002 Salvo et al.
6,357,292 B1 * 3/2002 Schultz et al.
6,377,868 B1 * 4/2002 Gardner, Jr. ..... 700/236
6,389,464 B1 * 5/2002 Krishnamurthy et al.
6,498,567 B1 * 12/2002 Grefenstette et al.
6,618,754 B1 * 9/2003 Gosling
6,792,637 B1 * 9/2004 Reichold et al. ..... 8/159
2001/0039501 A1 * 11/2001 Crevel et al.
2001/0047214 A1 * 11/2001 Cocking et al.
2001/0049846 A1 * 12/2001 Guzzi et al. ..... 8/158
2001/0053939 A1 * 12/2001 Crevel et al.
2001/0054038 A1 * 12/2001 Crevel et al.
2003/0106164 A1 * 6/2003 Metzger-Groom et al. .... 8/158
2004/0134238 A1 * 7/2004 Buckroyd et al. ..... 68/12.23

OTHER PUBLICATIONS

"Services Provided by Jaytech, Inc.", at http://www.jaytech.com, 2 pages.*
Clover Systems Inc.'s product description of InfAc, 4 pages, including specifications and features.*

* cited by examiner

METHOD AND SYSTEM FOR INSTALLATION AND CONTROL OF A UTILITY DEVICE

TECHNICAL FIELD

The invention relates generally to a utility device, and more particularly to installation of the utility device within an operational environment.

BACKGROUND

A warewash machine is a utility dishwasher used in many restaurants, healthcare facilities and other locations to efficiently clean and sanitize cooking and eating articles, such as, dishes, pots, pans, utensils and other cooking equipment. Articles are placed on a rack and provided to a washing chamber of the warewash machine. In the chamber, rinse agents and cleaning products are applied to the articles over a predefined period of time referred to as a "wash cycle." A wash cycle includes a cleaning cycle and a rinsing cycle. At least one cleaning product is applied to the articles during the cleaning cycle. The cleaning product is typically a chemical solution formed by dissolving one or more chemical products in water. The term chemical product is used broadly to encompass, without limitation, any type of detergent, soap or any other product used for cleaning and/or sanitizing.

At least one rinse agent is applied to the articles during the rinsing cycle. The rinse agent is typically water with one or more wetting and/or sanitizing agents. The article racks contain holes that enable the cleaning product and rinse agent to pass through the racks during the cleaning and rinsing cycles, respectively. At the end of the wash cycle, the rack is removed from the washing chamber so that other racks carrying other articles may be moved into the washing chamber. The wash cycle is then repeated for each of these subsequent racks. Wash cycles may be customized for specific types of racks and the articles that the racks carry.

The cleaning products (hereinafter, "chemical solutions") applied to the articles by the warewash machine are formed and contained in a solution tank typically located on the underside of the warewash machine. A wash module is provided above the solution tank and in the lower portion of the washing chamber. The wash module extracts a chemical solution from the tank and applies the solution to the articles contained in the rack during the cleaning cycle. Following the cleaning cycle, a rinse module, which is provided in the upper portion of the washing chamber, administers the rinsing cycle by applying a rinse agent to the articles thereby rinsing the chemical solution from the articles.

Operation of a warewash machine is dependent on various operational settings that affect the quality of a wash process. Such settings include, without limitation, a conductivity setpoint defining a target concentration of chemical product relative to all other chemicals (e.g., rinse agents, etc.) and particles (e.g., soil from articles, ions, minerals, etc.) within the chemical solution, an amount of rinse agent that is to be dispensed during a rinse cycle, a delay for dispensing the rinse agent and the chemical product upon initiation of a rinse cycle and a wash cycle, respectively, and a delay in signaling an alarm for indicating that the chemical product needs replenishing. In a commercial setting, operations of a warewash machine are typically monitored and controlled by a field service person employed by a service contractor or other like organization. As such, the field service person is responsible for setting these operational settings as part of his/her duty to ensure quality wash processes by the warewash machine.

Conventional systems require that the field service person set the operational settings based on information gathered on the environment in which the warewash machine will be or is being used. Such environmental information may be, for example, the hardness/softness of the water being used by the machine with the rinse agent, the actual or expected soil load that will be washed by the wash processes of the machine and the chemical characteristics of the chemical product used by the machine. This current approach is limited in that these operational settings are defined based on manual approximations by the field service persons taking into account the various types of environmental information. As with any manual approximation, the chance of human error affects the reliability that wash processes by the machine will satisfy a desired, or sometimes regulated, quality.

Further, if any of this environmental information were to change without the appropriate operational settings also being modified accordingly, the quality of the wash processes performed by the resident warewash machine is consequently affected. Service visits by field service persons are typically periodically scheduled for each particular warewashing location. Unfortunately, thus, it may be days, if not weeks, until a warewash machine associated with such an environmental change is serviced.

SUMMARY OF THE INVENTION

In accordance with the present invention, the above and other problems are solved by a computer-implemented method for configuring a utility device in a service environment where the utility device is intended to operate to perform at least one service. The method provides a graphical user interface through which a field service person inputs one or more parameters associated with the service environment. The method then analyzes these "environmental" parameters to determine operational settings for use by the utility device in performing the service. After the operational settings have been determined, the utility device is deployed for operation in the service environment based on these operational settings.

In an embodiment, the utility device is a device that performs a chemical process using a combination of a selected chemical product and water. As such, another embodiment of the present invention relates to a method for selecting the specific chemical product from a set of candidate chemical products. To accomplish this selection process, a plurality of test considerations associated with operation of the warewash machine within the specific operational environment are defined. The plurality of test considerations are then evaluated to render a determination on which of the plurality of candidate chemical products is to be selected as the specific chemical product. For example, in accordance with a specific embodiment, one of these plurality of test conditions may relate to a hardness level associated with the water used in the chemical process. In this specific embodiment, the hardness level is first determined and thereafter analyzed against each of the plurality of candidate chemical products to select therefrom the appropriate chemical product. The selected chemical product is then ready for use by the utility device in the service environment.

In accordance with another embodiment, the method also provides the field service person with the ability to modify operational settings prior to or during deployment of the utility device in the service environment. In this embodiment, the method includes presenting on the graphical user interface the operational settings as well as an electronic selection screen having an interface element. The interface element is manipulable by the field service person to modify at least one of the operational settings. In response to the user modifying an operational setting, the method updates the operational settings to include the modified operational setting.

In accordance with yet another embodiment, the present invention relates to a computer-implemented method for administering control over a utility device deployed to perform a service at the service environment. In this embodiment, the method provides a graphical user interface for entering one or more parameters associated with the service environment. These "environmental" parameters are analyzed to determine operational settings that are consequently used to control operation of the utility device. In addition, the method provides processes for modifying the operational settings in response to detection that one or more of the environmental parameters has changed. More specifically, in detection of a change in an environmental parameter, the method of this embodiment analyzes all parameters in conjunction with the modified parameter(s) to render a modified set of operational settings. The modified set of operational settings are then used to control operation of the utility device.

The environmental parameters relate to various type of information that affect the service performed by the device. For example, if the utility device is a warewash machine, exemplary parameters include, without limitation, the chemical product used to form the chemical solution that will be used to clean and/or sanitize articles placed in the machine, the hardness level of the water that will be used to form a rinse agent for rinsing the articles and the expected level of soil on the articles. These exemplary parameters, when analyzed by the method of the present invention, yield operational settings for use in controlling wash processes of the warewash machine. Exemplary operational settings include, without limitation, conductivity setpoint, amount of chemical product dispensed, amount of rinse agent dispensed and the length (in time) of the rinse cycle and the wash cycle for a single wash process.

Embodiments of the invention may be implemented as a computer process, a computing system or as an article of manufacture such as a solid state, non-volatile memory device or a computer program product or computer readable media. The computer program product may be a computer storage media readable by a computer system and encoding a computer program of instructions for executing a computer process. The computer program product may also be a propagated signal on a carrier readable by a computing system and encoding a computer program of instructions for executing a computer process.

These and various other features as well as advantages, which characterize the present invention, will be apparent from a reading of the following detailed description and a review of the associated drawings.

DETAILED DESCRIPTION

Figure 1:
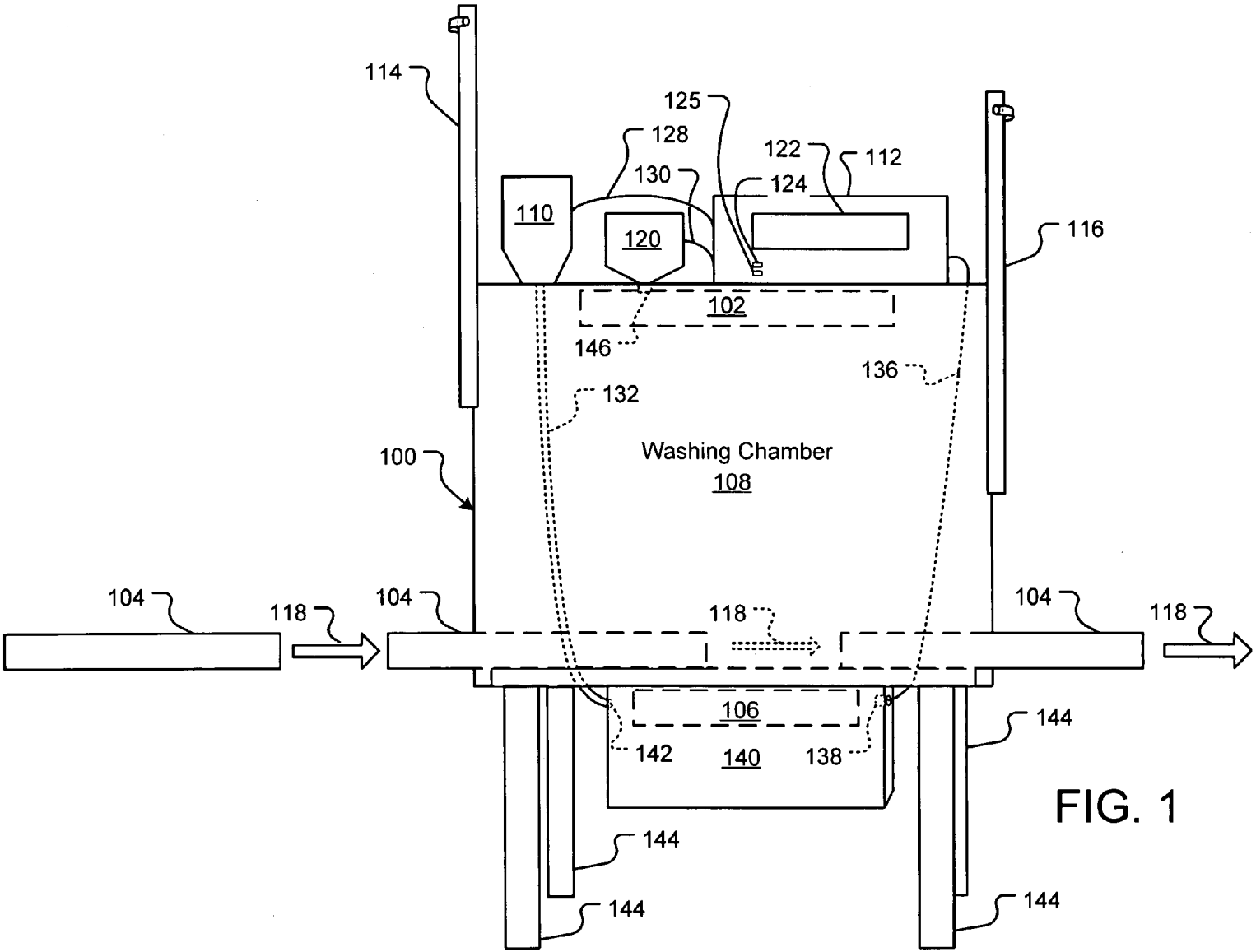
FIG. 1 illustrates components of a utility device, including a controller for controlling various operations of the utility device, in accordance with an embodiment of the present invention.

The present invention and its various embodiments are described in detail below with reference to the figures. When referring to the figures, like structures and elements shown throughout are indicated with like reference numerals. Objects depicted in the figures that are covered by another object, as well as the reference annotations thereto, are shown using dashed lines.

In an embodiment, the present invention relates to a computer-implemented process for configuring and administering control over operations of a utility device. For illustration only, and not by means of limitation, the utility device is described herein as being a cleaning apparatus, and more particularly a commercial dishwasher, which is also referred to as a "warewash machine." In this embodiment, logical operations of the present invention are performed by a warewash controller communicatively coupled to a product dispenser processor and/or a rinse module, wash module and/or various other processors used to effectuate operation of the warewash machine. It should be appreciated that the utility device may be any type of apparatus that prepares, formulates, allocates or otherwise utilizes a chemical solution to perform a task. In an embodiment, the chemical solution is a cleaning product for use in cleaning and/or sanitizing objects placed in or around the device. The chemical solution is defined herein as a combination of at least one chemical product and at least one rinse agent (e.g., water).

Referring now to FIG. 1, an exemplary warewash machine 100 is shown in accordance with an embodiment of the present invention. The warewash machine 100 is used to clean various types of dishware and kitchen objects, such as, without limitation, pots and pans used in restaurants, cafeterias and bakeries. Objects washed by the warewash machine 100 are hereinafter referred to as "articles." The articles are provided to the warewash machine 100 on article racks 104. The warewash machine 100 may be any type of warewash machine, such as, without limitation, a conveyor-type warewash machine, a flight-type warewash machine, a recirculating door-type warewash machine, or a commercial dump or fill-type dish machine. For illustrative purposes, however, the warewash machine 100 is described as being a conveyor-type warewash machine with standard article racks 104.

The warewash machine 100 includes a washing chamber 108, which, in the embodiment shown is enclosed by an entry sliding door 114 and an exit sliding door 116. The washing chamber 108 is supported above ground level by a plurality of legs 144. In operation, each article rack 104 carries one or more articles to be washed by the warewash machine 100 into the washing chamber 108 through an opened entry sliding door 114. Arrows 118, which are provided in FIG. 1 for illustration purposes only, show the direction of article racks 104 through the washing chamber 108 in accordance with an embodiment of the present invention. Once an article rack 104 is located inside the washing chamber 108, the entry sliding door 114 and the exit sliding door 116 are both closed to fully contain the washing chamber 108 on all sides.

A rinse module 102 is provided within or directly above the washing chamber 108 for applying a rinse agent to articles placed in the article racks 104. Although water is hereinafter described as the exemplary rinse agent, it should be appreciated that the water may include wetting agent(s) and/or sanitizing agent(s) dissolved therein. A wash module 106 is provided within or directly below the washing chamber 108 for applying a chemical solution to articles placed in the racks 104. The chemical solution cleans the articles for subsequent use in eating, cooking or otherwise utilizing. In an embodiment, the rinse module 102 and the wash module 106 include arms (not shown) operably mounted to a spindle (not shown) for rotation about the spindle axis. The arms of the rinse module 102 include a plurality of openings (not shown) through which water is passed to articles placed in the washing chamber 108. Likewise, the arms of the wash module 106 include a plurality of openings (not shown) through which the chemical solution is passed to articles placed in the washing chamber 108.

The chemical solution is formed and stored in a solution tank 140 positioned underneath the washing chamber 108. The chemical solution is formed as a combination of water provided by the rinse module 102 and one or more chemical products. For illustration purposes, and not by means of limitation, the chemical solution formed in the solution tank 140 is a combination of a single chemical product and water. A drain (not shown) is positioned within the solution tank 140 to enable the flow of used chemical solution out of the solution tank 140 and into a chemical waste system, such as a septic tank or sewer. The act of removing the chemical solution from the solution tank 140 is referred to as "flushing." In accordance with various embodiments, the chemical solution may be automatically flushed after each wash process or after a predetermined number of wash processes, or alternatively, some warewash machines may only allow manual flushing through the drain. The embodiment employed is a matter of implementation and it should therefore be appreciated that all means for flushing solution out of the solution tank 140 is contemplated within the scope of the present invention.

Prior to being provided to the solution tank 140, the chemical product used to form the chemical solution is stored in a product reservoir 110 in either a solid or liquid form. If the chemical product is stored as a solid, water is applied to the product to liquefy the chemical product such that the product may be provided to the solution tank 140 by way of a supply hose 132. Water is stored in a water reservoir 120 and dispensed into the washing chamber 108 by the rinse module 102. Water passes from the water reservoir 120 to the rinse module 102 by way of a coupling 146 therebetween. The rinse module 102 then applies the water to articles contained in a rack 104 situated in the washing chamber 108. An opening (not shown) is provided between the solution tank 140 and the washing chamber 108 to allow water provided to the washing chamber 108 to enter the solution tank 140. Water provided to the washing chamber 108 by the rinse module 102 passes through the opening into the solution tank 140, therein combining with pre-existing chemical solution to further dilute the chemical solution and therefore lower the concentration of chemical product in the solution.

Figure 9:
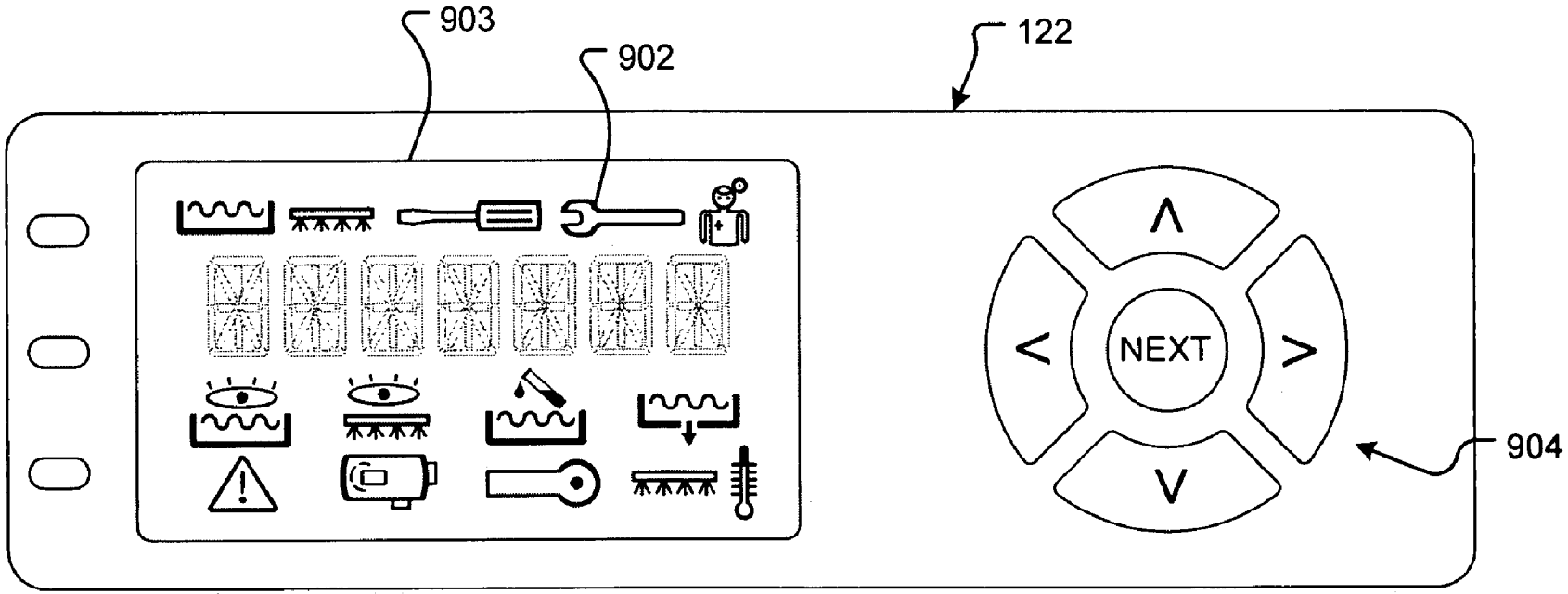
FIG. 9 depicts an exemplary graphical user interface providing user interaction to the controller of the utility device of FIG. 1 in accordance with an embodiment of the present invention.

In an embodiment of the present invention, various operations of the warewash machine 100 are controlled and monitored by a warewash controller 112. In this embodiment, the warewash controller 112 is connected by input/output lines to one or more display devices or modules, such as, without limitation, first and second status indicators 124 and 125, e.g., light emitting diodes (LED's), and a graphical user interface (GUI) 122. An exemplary graphical layout of information elements (icons) 902 on a selection screen 903 and user interface selection devices 904 is shown in FIG. 9 in accordance with an embodiment. The icons 902 indicate specific operational state(s) of the warewash machine 100. For example, without limitation, the icons 902 may show the currently feeding product (if any), which menu is active, alarm conditions, and certain exception conditions. The user interface selection devices 904 are used to input commands into the controller 112. The selection devices 904 are shown as up/down arrows in accordance with an exemplary embodiment. These up/down arrows may be used to alternate selections on the current menu as well as increase/decrease a parameter value (e.g., environmental or operational parameter).

As described in more detail below, the GUI 122 provides a computer-assisted means through which field service persons can set up and deploy the warewash machine 100 into operation in an intended service environment, such as, a restaurant, a hotel, etc. It should be appreciated that the GUI 122 is shown for illustration purposes only and, therefore should not be construed to limit the scope of the present invention. Indeed, it will be understood by those of skill in the art that any conventional GUI (e.g., touch-screen interfaces, mouse-based interfaces, keyboard-based interfaces, etc.) may be programmed to implement embodiments of the present invention. More detailed illustrations of GUI functionality provided by embodiments of the present invention is described below in connection with FIGS. 3–7.

The warewash controller 112 performs operations stored as firmware or software to control and monitor various tasks administered by the warewash machine 100 during operation. For example, without limitation, in response to detecting initiation of a wash cycle for each rack 104 provided to the warewash machine 100, the controller 112 controls dispensing of the chemical product to the solution tank 140. To accomplish this, the warewash controller 112 measures the current conductivity of the chemical solution resident in the solution tank 140, and based on this measurement, controls the amount of the chemical product dispensed to the solution tank 140. In an embodiment, the controller 112 may also control initiation and operation of the wash module 106 and the rinse module 102 during each wash cycle performed by the warewash machine 100. Furthermore, the warewash controller 112 generates information for display on the graphical user interface 122 as well as first and second status indicators 124 and 125 based on the various tasks that the controller 112 controls and monitors.

In order to provide such control, however, the warewash controller 112 must first be programmed for the specific environment in which the warewash machine 100 will operate. Processes related to such programming are described in greater detail with reference to FIGS. 3–7. In an exemplary embodiment, the warewash controller 112 is a special-purpose programmable controller 112 manufactured by NOVA Controls. However, it should be appreciated that the warewash controller 112 may be any type or make of controller 112 known to those skilled in the art.

In accordance with various embodiments, the warewash controller 112 administers the aforementioned control and monitoring operations using a chemical product output control line 128, a water output control line 130 and a conductivity input control line 136, each input to the warewash controller 112. The chemical product output control line 128 couples the warewash controller 112 to a processor (not shown) responsible for dispensing the chemical product from the product reservoir 110. The warewash controller 112 transmits signals to the product reservoir processor over the chemical product output control line 128. These signals direct the product reservoir processor to dispense a particular volume of chemical product to the solution tank 140. If the chemical product is stored in the product reservoir 110 in a solid form, the product reservoir processor activates a water pump that applies a predetermined volume of water to the solidified chemical product. Upon the application of this predetermined volume of water, an associated volume (with respect to the predetermined volume of water) of the chemical product in a liquid form is created and dispensed out of the product reservoir 110.

The water output control line 130 couples the warewash controller 112 to a processor (not shown) responsible for dispensing water from the water reservoir 120. In an embodiment, the water reservoir processor controls operation of a water pump (not shown) that pushes water through an output of the water reservoir 120 and into the rinse module 102. The warewash controller 112 transmits signals to the water reservoir processor over the water output control line 130. These signals direct the water reservoir processor to activate the water pump to dispense a predetermined volume of water to the rinse module 102. Almost simultaneously, the warewash controller 112 also directs the rinse module 102 to provide the water to the washing chamber 108 for application to articles contained in an article rack 104 currently situated therein. The water passes over the articles and to the solution tank 140, where the water combines with chemical solution already contained in the tank 140, thereby diluting the solution.

As the chemical solution resides in the solution tank 140, the warewash controller 112 takes conductivity measurements of the chemical solution in order to monitor concentration of the chemical product relative to all other chemicals (e.g., rinse agents, etc.) and particles (e.g., soil from articles, ions, minerals, etc.) within the chemical solution. To accomplish this, the conductivity input control line 136 couples the warewash controller 112 to an inductive probe 138 operable for sensing information, e.g., electrical properties, for use in determining the conductivity of the chemical solution. This sensed information, which is provided to the warewash controller 112 over the conductivity input control line 136, is used by the warewash controller 112 to calculate conductivity of the chemical solution. As such, information linking these electrical properties, e.g., generated voltages, to associated conductivity readings is stored within memory local to the warewash controller 112.

Similarly, each conductivity reading is linked, directly or indirectly, to an associated percent concentration of the chemical product. A target, or setpoint, conductivity reading (hereinafter "conductivity setpoint") is associated with the desired percent concentration for the chemical product relative to all other chemicals (e.g., rinse agents, etc.) and particles (e.g., soil from articles, ions, minerals, etc.) within the chemical solution. The warewash controller 112 compares the conductivity setpoint to each conductivity measurement to determine whether a predetermined quantity of chemical product should be added to the solution to meet the conductivity setpoint, and thus, the desired percent concentration. A computer implemented process for defining the conductivity setpoint using the graphical user interface 122 is described in greater detail below with reference to FIG. 5.

Inductive probes and the methods used by inductive probes to measure conductivity are well known in the art and not described in further detail herein. In an exemplary embodiment, the inductive probe 138 is a Model 28.740.7, manufactured by Lang Apparatebau GmbH. However, it should be appreciated that the inductive probe 138 may be any type or make of inductive probe known to those skilled in the art. Furthermore, the inductive probe 138 may be replaced in an alternative embodiment by one or more conductivity cells. For example, U.S. Pat. No. 4,733,798 teaches conventional electrode-bearing conductivity cells and electrode-less conductivity cells as well as use thereof in measuring conductivity of a chemical solution and controlling concentration of the chemical product(s) contained therein.

The first and second status indicators 124 and 125 indicate the current operation of the warewash machine 100. For example, the first status indicator 124 may indicate to users that the warewash machine 100 is currently activated and in the middle of a wash cycle. The second status indicator 125 may indicate to users that the warewash machine 100 is not only activated, but that the chemical product is currently being dispensed to the solution tank 140. It should be appreciated that the status indicators 124 and 125 may be used for any other purpose related to operating characteristics of the warewash machine 100.

The GUI 122 is administered by a program implemented on the warewash controller 112 that provides a field service person with the ability to monitor and define settings associated with operation of the warewash machine 100. These settings are hereinafter referred to as "operational settings." As described in more detail below, the GUI 122 presents to users various interface screens that enable the users to input environmental parameters such that the controller 112 may define operational settings (conductivity setpoint, water and product dispense amounts and delay times associated with such dispensing) for the warewash machine 100. Thereafter, the GUI 122 also provides users with the computer-assisted ability to modify or alter operational settings defined for a particular environment. In addition, the graphical user interface 122 may be used to limit operating access of the warewash machine 100 to authorized users.

Figure 2:
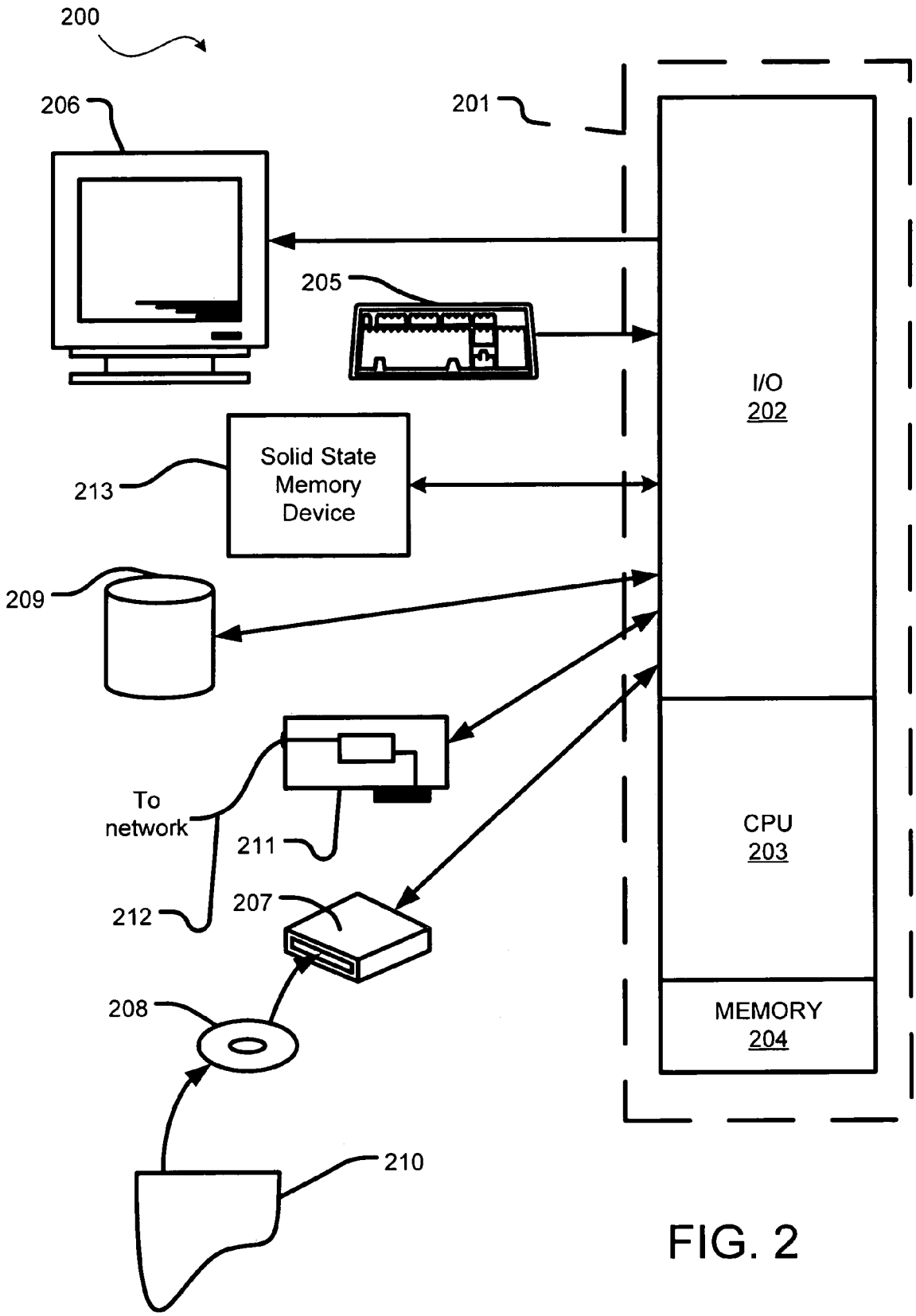
FIG. 2 depicts a general-purpose computer that implements logical operations of an embodiment of the present invention.

FIG. 2 depicts a computing system 200 capable of executing a program product embodiment of the present invention. One operating environment in which the present invention is potentially useful encompasses a computing system 200 that includes, for example, the GUI 122, the warewash controller 112 and any components controlled and/or monitored by the controller 112, or a remote computer to which information collected by the warewash controller 112 may be uploaded. In such a system, data and program files may be input to the computing system 200, which reads the files and executes the programs therein. Some of the elements of a computing system 200 are shown in FIG. 2 wherein a controller 112 (e.g., warewash controller 112), illustrated as a processor 201, is shown having an input/output (I/O) section 202, a microprocessor, or Central Processing Unit (CPU) 203, and a memory section 204. The present invention is optionally implemented in software or firmware modules loaded in memory 204 and/or stored on a solid state, non-volatile memory device 213, a configured CD-ROM 208 or a disk storage unit 209. As such, the computing system 200 is used as a "special-purpose" machine for implementing the present invention.

The I/O section 202 is connected to a user input module 205, e.g., a keyboard, a display unit 206 and one or more program storage devices, such as, without limitation, the solid state, non-volatile memory device 213, the disk storage unit 209, and the disk drive unit 207. The user input module 205 is shown as a keyboard, but may also be any other type of apparatus for inputting commands into the processor 201. The solid state, non-volatile memory device 213 is an embedded memory device for storing instructions and commands in a form readable by the CPU 203. In accordance with various embodiments, the solid state, non-volatile memory device 213 may be Read-Only Memory (ROM), an Erasable Programmable ROM (EPROM), Electrically-Erasable Programmable ROM (EEPROM), a Flash Memory or a Programmable ROM, or any other form of solid state, non-volatile memory. In accordance with one embodiment, the disk drive unit 207 is a CD-ROM driver unit capable of reading the CD-ROM medium 208, which typically contains programs 210 and data. Computer program products containing mechanisms to effectuate the systems and methods in accordance with the present invention may reside in the memory section 204, the solid state, non-volatile memory device 213, the disk storage unit 209 or the CD-ROM medium 208.

In accordance with an alternative embodiment, the disk drive unit 207 may be replaced or supplemented by a floppy drive unit, a tape drive unit, or other storage medium drive unit. A network adapter 211 is capable of connecting the computing system 200 to a network of remote computers via a network link 212. Examples of such systems include SPARC systems offered by Sun Microsystems, Inc., personal computers offered by IBM Corporation and by other manufacturers of IBM-compatible personal computers, and other systems running a UNIX-based or other operating system. A remote computer may be a desktop computer, a server, a router, a network PC (personal computer), a peer device or other common network node, and typically includes many or all of the elements described above relative to the computing system 200. Logical connections may include a local area network (LAN) or a wide area network (WAN). Such networking environments are commonplace in offices, enterprise-wide computer networks, intranets, and the Internet.

In accordance with a program product embodiment of the present invention, software instructions stored on the solid state, non-volatile memory device 213, the disk storage unit 209, or the CD-ROM 208 are executed by the CPU 203. In this embodiment, these instructions may be directed toward communicating data between the controller 112 and a remote computer and analyzing data, such as, without limitation, environmental parameters and operational settings, to set up and/or control operation of the controller 112. Data, such as environmental parameters and operational settings, may be stored in memory section 204, or on the solid state, non-volatile memory device 213, the disk storage unit 209, the disk drive unit 207 or other storage medium units coupled to the system 200.

In accordance with one embodiment, the computing system 200 further comprises an operating system and usually one or more application programs. Such an embodiment is familiar to those of ordinary skill in the art. The operating system comprises a set of programs that control operations of the computing system 200 and allocation of resources. The set of programs, inclusive of certain utility programs, also provide a graphical user interface to the user. An application program is software that runs on top of the operating system software and uses computer resources made available through the operating system to perform application specific tasks desired by the user. In accordance with an embodiment, the operating system employs a graphical user interface (e.g., 122) wherein the display output of an application program is presented in a rectangular area on the selection screen (e.g., 903) of the display device 206. The operating system is operable to multitask, i.e., execute computing tasks in multiple threads, and thus may be any of the following: Microsoft Corporation's "WINDOWS 95," "WINDOWS CE," "WINDOWS 98," "WINDOWS 2000" or "WINDOWS NT" operating systems, IBM's OS/2 WARP, Apple's MACINTOSH OSX operating system, Linux, UNIX, etc.

In accordance with the practices of persons skilled in the art of computer programming, the present invention is described below with reference to acts and symbolic representations of operations that are performed by the warewash controller 112 or a remote computer communicating therewith, unless indicated otherwise. Such acts and operations are sometimes referred to as being computer-executed or computer-implemented. It will be appreciated that the acts and symbolically represented operations include the manipulations by the CPU 203 of electrical signals representing data bits causing a transformation or reduction of the electrical signal representation, and the maintenance of data bits at memory locations in the memory 204, the solid state, non-volatile memory device 213, the configured CD-ROM 208 or the storage unit 209 to thereby reconfigure or otherwise alter the operation of the computing system 200, as well as other processing signals. The memory locations where data bits are maintained are physical locations that have particular electrical, magnetic, or optical properties corresponding to the data bits.

The logical operations of the various embodiments of the present invention are implemented either manually and/or (1) as a sequence of computer-implemented steps running on the warewash controller 112, and/or (2) as interconnected machine modules within the controller 112. The implementation is a matter of choice dependent on the performance requirements of the computing system implementing the invention. Accordingly, the logical operations making up the embodiments of the present invention described herein are referred to alternatively as operations, acts, steps or modules. It will be recognized by one skilled in the art that these operations, structural devices, acts and modules may be implemented in software, in firmware, in special purpose digital logic, and any combination thereof without deviating from the spirit and scope of the present invention as recited within the claims attached hereto.

Figure 3:
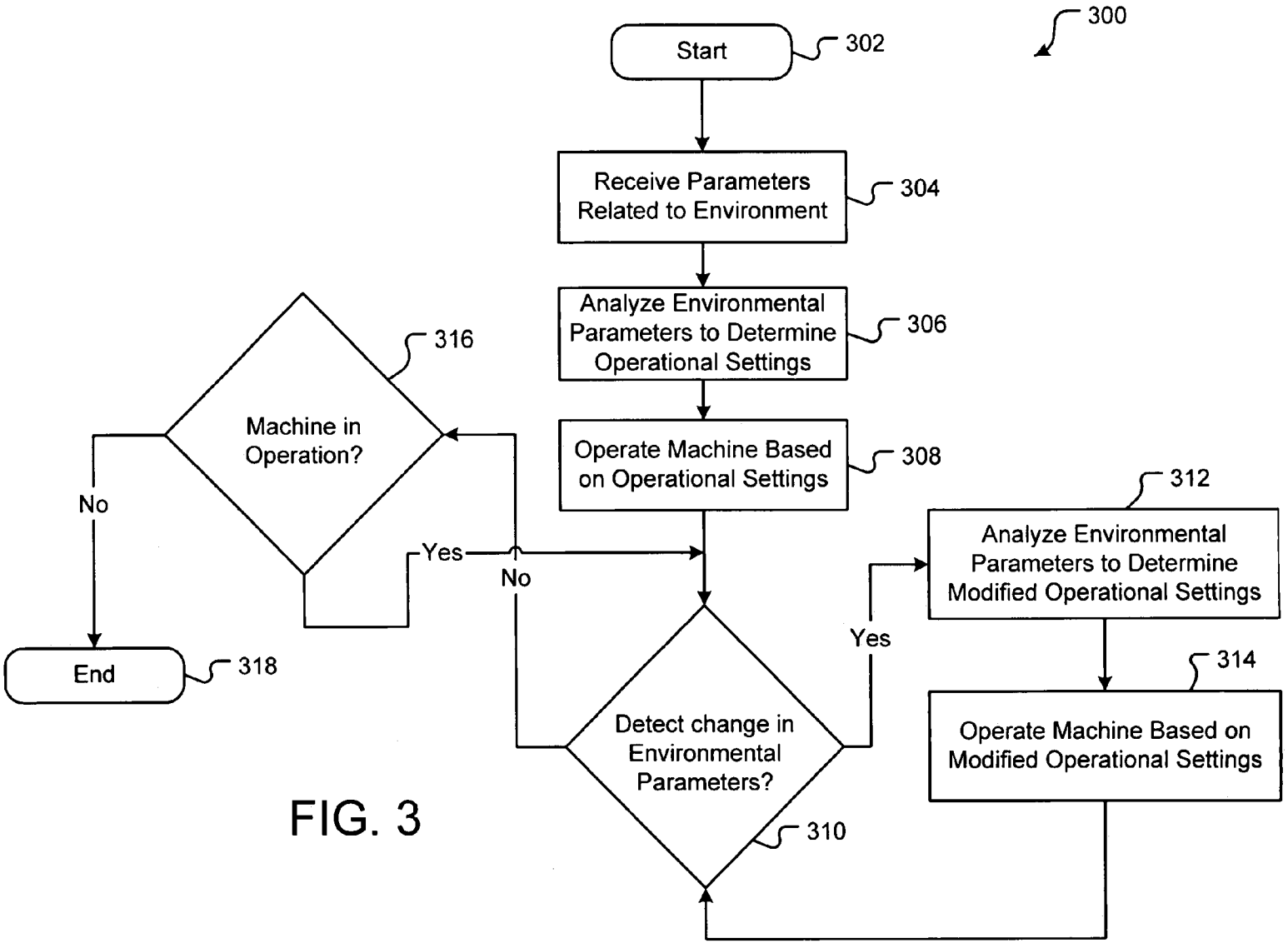
FIG. 3 is a flow diagram illustrating operational characteristics of a computer-implemented process for controlling operation of a utility device in accordance with an embodiment of the present invention.

With the computing environment in mind, FIG. 3 illustrates operational characteristics of a process 300 for administering control over a utility device in a specific environment where the machine is providing a service. Such an environment is hereinafter referred to as a "service" or "operational" environment, and may be, for example, a restaurant, a cafeteria, a hotel, office building, convention center or the like. For exemplary purposes, the utility device is described as being a warewash machine 100. As such, this process 300, referred to herein as "control process," is performed in whole or in part by the warewash controller 112 described above. It should be appreciated that other computing devices, such as devices communicating with the warewash controller 112 over a communications network, may perform one or more of the operations of the control process 300 in conjunction with the warewash controller 112.

The control process 300 is performed using a flow of operations ("operation flow") that begins at a start operation 302 and concludes at a terminate operation 318. In an embodiment, the start operation 302 and the terminate operation span the life cycle of the warewash machine 100 in the service environment. In this embodiment, the start operation 302 is initiated when the warewash machine 100 is deployed for operation at the service environment. Deployment at a service environment involves the installation of the machine 100 at the service environment by a field service person. Thus, the description of human interaction with several of the operations included in this and later processes (FIGS. 4–7) refer to interaction by this field service person in charge of the machine installation. From the start operation 302, the operation flow passes to a receive operation 304.

The receive operation 304 receives information associated with the service environment in which the warewash machine 100 is being deployed. In an embodiment, this information is input to the receive operation 304 by a field service person interacting with the GUI 122. Alternatively, the field service person may be interacting with a GUI on a client computer 802 that is communicatively connected to the warewash controller 112 by a network 800, as conceptually shown in FIG. 8. Regardless of the implementation, the field service person inputs information associated with the service environment and the warewash controller 112 consequently receives these parameters by way of the receive operation 304. For nomenclature purposes, this information is hereinafter referred to as "environmental parameters. Exemplary environmental parameters include, without limitation, a parameter defining the hardness level of the water that will be used by the machine 100 to create the rinse agent, a parameter defining the actual or expected soil load associated with articles that will be washed by the machine 100 and one or more parameters defining the chemical product that will be used by the machine 100. Other forms of environmental parameters exist, such as, without limitation, machine type, operation mode, average length of the wash cycles performed by the machine 100, the average temperature of water used by the rinse cycles performed by the machine 100, the average pressure of product or water dispensed on the articles during a wash process, a rating indicative of warewashing procedures at the location where the machine 100 is being installed, etc. After the environmental parameters have been received by the receive operation 304, the operation flow passes to an analysis operation 306.

The analysis operation 306 analyzes the environmental parameters input by the field service person in order to determine operational settings for the warewash machine 100. In an embodiment, this analysis involves the use of a data structure stored on the controller 112 (or alternatively, a remote computer) and containing pre-stored data that associates all potential groupings of environmental parameters to a predetermined set of operational settings. Thus, the analysis operation 306 references this data structure with the received information in order to map the received information to the appropriate set of operational settings. One manner in which this data structure may be set up is in the form of a table. Table 1, below, illustrates an exemplary data structure mapping various environmental parameters to predetermined operational settings.

TABLE 1

Exemplary Data Structure Mapping Exemplary Environmental Parameters to Exemplary Operational Settings

| Product | Soil Level | Water | Drops | Setpoint | Delay |
|---|---|---|---|---|---|
| Product 1 | Light | Soft | 12 | 27 | 300 |
| Product 1 | Light | Medium | 12 | 27 | 300 |
| Product 1 | Light | Hard | 12 | 27 | 300 |
| Product 1 | Normal | Soft | 15 | 33 | 300 |
| Product 1 | Normal | Medium | 15 | 33 | 300 |
| Product 1 | Normal | Hard | 15 | 33 | 300 |
| Product 1 | Heavy | Soft | 15 | 33 | 300 |
| Product 1 | Heavy | Medium | 15 | 33 | 300 |
| Product 1 | Heavy | Hard | 18 | 40 | 300 |
| Product 2 | Light | Soft | 12 | 27 | 180 |
| Product 2 | Light | Medium | 12 | 27 | 180 |
| Product 2 | Light | Hard | 12 | 27 | 180 |
| Product 2 | Normal | Soft | 15 | 33 | 180 |
| Product 2 | Normal | Medium | 15 | 33 | 180 |
| Product 2 | Normal | Hard | 15 | 33 | 180 |
| Product 2 | Heavy | Soft | 15 | 33 | 180 |
| Product 2 | Heavy | Medium | 15 | 33 | 180 |
| Product 2 | Heavy | Hard | 18 | 40 | 180 |
| Product 3 | Light | Soft | 12 | 20 | 450 |
| Product 3 | Light | Medium | 12 | 20 | 450 |
| Product 3 | Light | Hard | 12 | 20 | 450 |
| Product 3 | Normal | Soft | 15 | 25 | 450 |
| Product 3 | Normal | Medium | 15 | 25 | 450 |
| Product 3 | Normal | Hard | 15 | 25 | 450 |
| Product 3 | Heavy | Soft | 15 | 25 | 450 |
| Product 3 | Heavy | Medium | 15 | 25 | 450 |
| Product 3 | Heavy | Hard | 18 | 30 | 450 |

To illustrate further the analysis operation 306, assume the following environmental parameters are received by the receive operation 304: (a) the chemical product for use in the machine 100 is "Product 3," (b) the soil level is defined as being "light," and (c) the water type is defined as being "hard." In this example the resulting set of operational setting will be as follows: (a) the quantity of chemical product to be dispensed at each product dispensing is 12 drops; (b) the conductivity setpoint is defined to be 20 units; and (c) the delay (from detection of conductivity setpoint) that will be applied to product dispensing is 450 milliseconds. The table shown is exemplary only and may contain many more environmental parameters and operational settings. Indeed, it is contemplated that the data structure used by the analysis operation 306 may include any numbers of rows and columns. Regardless of how this data structure is constructed, the analysis operation 306 yields the predetermined set of operational settings corresponding to the received set of environmental parameters. Then, the operational flow passes to an activate operation 308.

The activate operation 308 initiates operation of the warewash machine 100 at the service environment. Operation of the machine 100 after activation is controlled by the controller 112 based on the determined operational settings. For instance, referring to the example described above, the controller 112 will dispense 12 drops of chemical product to the solution tank 140 four-hundred fifty milliseconds after detecting that the conductivity of the chemical solution has reached the setpoint of 20 units. After the machine 100 is operational, the operation flow passes to a first query operation 310. The first query operation 310 determines whether any of the received environmental parameters have changed since performance of the analysis operation 306. If none of the environmental parameters have changed, the operation flow passes to a second query operation 316. Alternatively, the operation flow passes to an update operation 312 if any one of the environmental parameters have changed since performance of the analysis operation 306.

The update operation 312 performs the same analysis that was performed by the analysis operation 306, except that the set of environmental parameters analyzed against the data structure includes the one or more changed parameters. The result of this analysis is a modified set of operational settings. Referring back to the example above, if the soil level of the service environment were to change from "light" to "normal," then the modified operational settings include the following settings: a) the quantity of chemical product to be dispensed at each product dispensing is 15 drops; (b) the conductivity setpoint is defined to be 25 units; and (c) the delay (from detection of conductivity setpoint) that will be applied to product dispensing is 450 milliseconds, which actually remains the same. After the modified set of operational settings has been determined, the operation flow passes to an operate operation 314.

The operate operation 314 initiates control over the operation of the warewash machine 100 based on the modified set of operational settings. As such, the warewash controller 112 maintains operation of the machine 100 based on these modified settings even after the operation flow passes from the operate operation 314, from which the operation flow goes back to the first query 310. Again, the first query operation checks to see if any of the environmental parameters used to derive the current operational settings have been changed. As noted above, if such a change is not the case, the operation flow passes to the second query operation 316.

The second query operation 316 determines whether the warewash machine 100 is still in operation at the service environment. If so, the operation flow is passed directly back to the first query operation 310 and consequently loops between the first query operation 310 and the second query operation 316 until either an environmental parameter is changed or operation of the machine 100 at the service location is ceased. If operation of the machine 100 is indeed ceased, the operation flow concludes at the termination operation 318.

Figure 4:
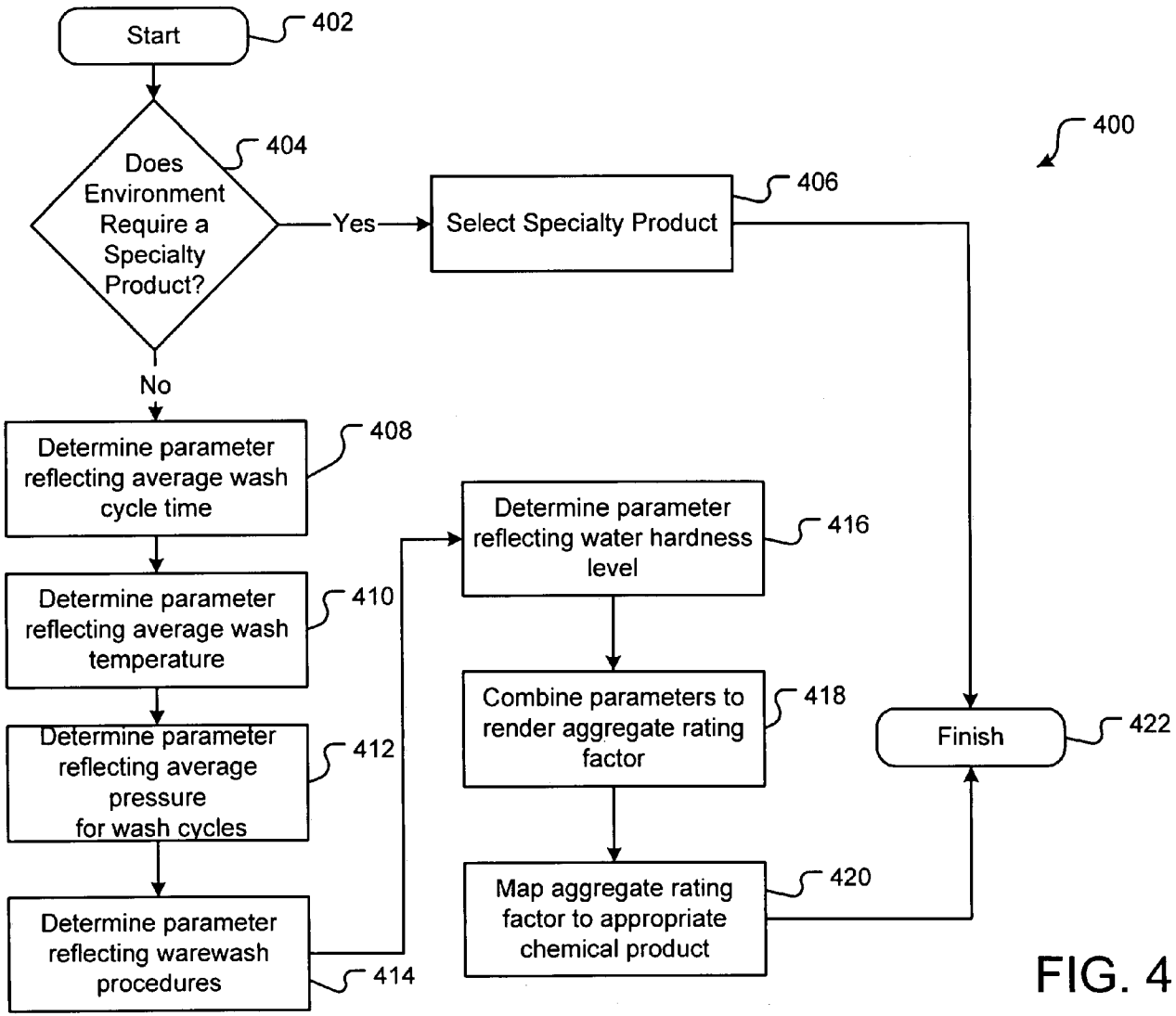
FIG. 4 is a flow diagram illustrating exemplary operational characteristics for selecting a chemical product for use by the warewash machine of FIG. 1 in accordance with an embodiment of the present invention.

As described above in connection with the receive operation 304, various environmental parameters affecting control over operations of the warewash machine 100 must be known in order to subsequently perform the control process 300. One such parameter is the specific chemical product that will be used by the machine 100 to clean the articles placed therein. FIG. 4 is a flow diagram illustrating exemplary operational characteristics associated with a process 400 for selecting (hereinafter, "selection process") this specific chemical product for use by the machine 100 in accordance with an embodiment of the present invention. As such, the selection process 400 is performed to select one chemical product from multiple chemical products that may be used by the machine 100. For nomenclature purposes, each of these chemical products that may be selected by the selection process 400 are collectively referred to herein as a "set of candidate chemical products" and individually referred to herein using alphabetic references (e.g., chemical product A, chemical product B, chemical product C, etc.). It should be appreciated that the set of candidate chemical products may include any number of chemical products and further may include any chemical product that may be used to clean and/or sanitize articles within the warewash machine 100. In alternative embodiments wherein the utility device is a laundry machine or other device utilizing a selected chemical product, the set of candidate chemical products consequently includes chemical products operable for use by these other devices.

In accordance with one embodiment, the selection process 400 is a manual process performed by the field service person. In accordance with another embodiment, the selection process 400 is a process performed as the field service person interacts with a graphical user interface of a computer system, such as the controller 112, and thus, the GUI 122. In this embodiment, at least some of the operations of the selection process 400 are embodied in a computer process performed by the computer system. In either embodiment, various operations of this selection process 400 involve the analysis of considerations associated with the particular environment. These considerations are described in detail below, but include, without limitation, whether articles washed by the warewash machine 100 require a special chemical product, the hardness level of the water that will be used by the warewash machine 100, the average pressure, cycle time and temperature associated with the wash cycles performed in the warewash machine 100 and a rating of the actual or anticipated warewash procedures implemented in the environment. Information used to make determinations based on these considerations is gathered by the field service person by either direct measurements (e.g., testing water hardness levels, etc.), questioning individuals with knowledge of the particular environment or monitoring the particular environment. As such, this information may be gathered using a survey or questionnaire that includes a query directed to each of these considerations. Exemplary considerations are now described in further detail in context of the selection process 400.

The selection process 400 according to this exemplary embodiment is performed using an operation flow beginning with a start operation 402 and concluding with a terminate operation 422. As noted above, the start operation 402 is initiated prior to a field service person configuring a warewash machine 100 for operation within a particular environment. As such, the start operation 402 may be accomplished either prior to installation of the warewash machine 100 in the particular environment if this is a new installation or while the machine 100 is currently operating (i.e., a pre-existing machine) in the particular environment if the field service person is responsible for changing the chemical product used by the pre-existing machine 100. For illustrative purposes only, and not by means of limitation, the selection process 400 is described in context of a warewash machine 100 being installed in the particular environment. Regardless of the circumstance, the operation flow passes from the start operation 402 to a query operation 404.

The query operation 404 queries whether the particular environment requires a specialty chemical product. In an embodiment, specialty chemical products are those chemical products within the set of candidate chemical products designed for articles that require special care. In this embodiment, selection of a specialty chemical product does not take into account any environmental parameters that are taken into account for other candidate products in the set, as described in more detail below. Exemplary articles that require special care include, without limitation, articles that require a chemical product that is safe for use on metals, articles that require a chemical product that removes stain and articles that require a chemical product with glassware protection. If the query operation 404 determines that the articles which are to be cleaned and/or sanitized by the warewash machine 100 fall into either of these exemplary categories, then the operation flow passes to a specialty selection operation 406. The specialty selection operation 406 selects the appropriate specialty chemical product and the operation flow then concludes at the terminate operation 422 without any other factors being considered by the selection process 400.

If, however, the query operation 404 determines that a specialty chemical product is not required by the articles that will be cleaned and/or sanitized by the warewash machine 100, the operation flow is passed to a set of operations that evaluate certain considerations associated with the particular service environment in which the machine 100 is being installed in order to render an aggregate factor for use in selecting a chemical product from the set of candidate chemical products. These operations are referred to as "determination" operations and are used to assign to the machine 100 individual parameter values for each associated consideration. After each of these parameter values are calculated, these values are added together to render the aggregate factor. For illustrative purposes, and not by means of limitation, the selection process 300 is described as having five determination operations. It should be appreciated that these five determination operations are exemplary only. Indeed, other determination operations may be used in the selection process 400 in combination with or as replacements to these described exemplary operations. To that end, these exemplary determination operations are described in turn below.

The first exemplary determination operation 408 determines a parameter value (hereinafter, "first parameter value") reflecting a predetermined range into which an average wash cycle time is included. The average wash cycle time represents the average time that it takes the warewash machine 100 to perform an entire wash cycle. For example, if the average wash cycle is greater than 60 seconds, then the first parameter value is 0; if the average wash cycle is less than 60 seconds, but greater than 45 seconds, then the first parameter value is 0.05; and if the average wash cycle is less 45 seconds, then the first parameter value is 0.1.

The second exemplary determination operation 410 determines a parameter value (hereinafter, "second parameter value") reflecting a predetermined range into which an average wash temperature is included. The average wash temperature represents the average temperature of water dispensed into the washing chamber 108 during wash cycles performed by the machine 100. For example, if the average wash temperature is greater than 150 degrees Fahrenheit, then the second parameter value is 0; if the average wash cycle is less than 150 degrees Fahrenheit, but greater than 130 degrees Fahrenheit, then the second parameter value is 0.125; and if the average wash cycle is less 130 degrees Fahrenheit, then the second parameter value is 0.25.

The third exemplary determination operation 412 determines a parameter value (hereinafter, "third parameter value") reflecting a predetermined range into which the average pressure with which chemical product is dispensed into the washing chamber 108 is included. For example, if the average dispense pressure is greater than 15 psi, then the third parameter value is 0 and if the average dispense pressure is less than 15 psi, then the third parameter value is 0.35.

The fourth exemplary determination operation 414 determines a parameter value (hereinafter, "fourth parameter value") reflecting a predetermined range into which warewashing procedures associated with the particular environment are rated. This rating is a subjective rating that is made by the field service person. This rating may be based on various procedures that collectively denote the procedures implemented in the particular environment as being good, average or poor, i.e., completely out of the norm. An exemplary consideration that may go into formulating this rating includes, without limitation, the soil load expected to be encountered during each wash cycle. The soil load may be measured in either the amount of soil that is expected to be on each article during a single wash cycle or the amount of solid that is expected to be on all articles in a rack 104 during a single wash cycle. For example, if the rating reflects that the procedures are good (e.g., low soil level expected), then the fourth parameter value is 0; if the rating reflects that the procedures are average (e.g., average soil level expected), then the fourth parameter value is 0.3; and if the rating reflects that the procedures are poor (e.g., above-average soil level expected), then the fourth parameter value is 0.6.

The fifth exemplary determination operation 416 determines a parameter value (hereinafter, "fifth parameter value") reflecting a predetermined range into which the water hardness level of the water associated with the particular environment is rated. Water hardness level refers to whether the water that will be used by the warewash machine 100 is soft, hard or medium. As known to those skilled in the art, these levels are measured in terms of grains. For example, if the water hardness level is 0–3 grains, then the fifth parameter value is 0; if the water hardness level is between 4–7 grains, then the fifth parameter value is 0.35; if the water hardness level is between 8–10 grains, then the fifth parameter value is 0.7; and if the water hardness level is greater than 10 grains, then the fifth parameter value is 1.4.

After each of the determination operations have been completed and a parameter value reflecting the results of each of the associated considerations has been rendered, the operation flow passes to an aggregate parameter value operation 420. The aggregate parameter value operation 420 combines all rendered parameter values to render the aggregate rating factor introduced above. After this aggregate rating factor has been calculated, the operation flow passes to a product select operation 420. The product select operation 420 selects the appropriate chemical product for the particular environment based on the aggregate rating factor. In an embodiment, this selection is made using a table that maps each of the candidate chemical products in the set of candidate chemical products to a range of aggregate rating values. As noted above, the selection process 400 may be performed manually or as a computer process implemented on a computing system. If performed as a computer process implemented on a computing system, this table is stored on the computing system as a data structure accessible to the computer process at a specified location. An exemplary table for use by the product select operation 420 is shown below as Table 2:

TABLE 2

| Exemplary Table Mapping Aggregate Rating Factor to Candidate Chemical Products | |
|---|---|
| Aggregate Rating Factor (x) | Recommended Chemical Product |
| $0 < x \leqq .6$ | Chemical Product A |
| $.6 < x \leqq .9$ | Chemical Product B |
| $.9 < x \leqq 1.3$ | Chemical Product C |
| $1.3 < x \leqq 1.6$ | Chemical Product D |
| $x > 1.6$ | Chemical Product E |

After the appropriate chemical product has been selected using the aggregate parameter value operation 420, the operation flow concludes at the terminate operation 422.

Figure 5:
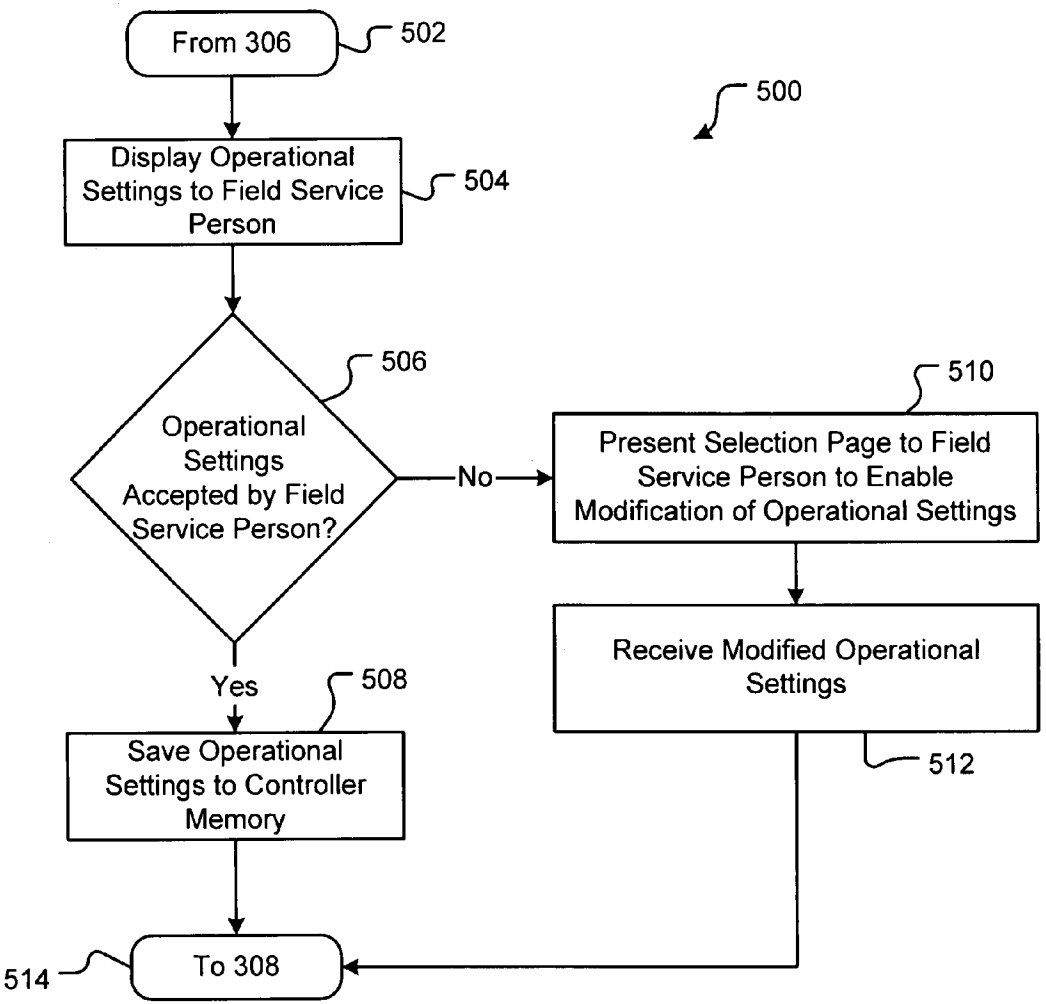
FIG. 5 is a flow diagram illustrating operational characteristics for enabling modification of operational settings determined by the process of FIG. 3.

Turning now to FIG. 5, a process 500 for providing the field service person installing the warewash machine 100 with access to the operational settings rendered by the warewash controller 112 is shown in accordance with an embodiment of the present invention. In this embodiment, the "access process" 500 is an optional set of operations that may be performed to enable the field service person to view and modify the operational settings rendered by the analysis operation 306. As with the control process 300, the logical operations of the access process 500 are performed by the warewash controller 112 in accordance with an embodiment of the present invention.

The access process 500 is performed by an operation flow that begins at a first transfer operation 502 and concludes at a second transfer operation 514. These transfer operations connect the operation flow of the control process 300 and the access process 500 in order to provide one collective flow of operations. More particular, if the access process 500 is employed, the operation flow of the control process 300 is transferred after the analysis operation 306 to the access process 500 by the first transfer process 502. From the first transfer process 502, the operation flow passes to a display operation 504.

The display operation 504 presents the determined operational settings to the field service person over the GUI 122. Alternatively, and in the embodiment of FIG. 8, these operational settings may be presented to the field service person interacting with the warewash controller 112 from a remote location. In this embodiment, the field service person is presented these operational settings on a GUI implemented on a client computer 802 communicatively connected to the warewash controller 112 over a communications network 800. Regardless of the embodiment used, the display operation 504 also presents to the field service person a selection screen through which the field service person may accept or reject the operational settings determined by the analysis operation 306. From the display operation 504, the operation flow passes to a third query operation 506.

The third query operation 506 determines whether the field service person has accepted or rejected the determined operational settings. If the field service person has accepted each of these settings, the operational flow passes to a save operation 508. The save operation 508 saves the operational settings to memory accessible by the warewash controller 112 such that the controller 112 may use the settings to control operation of the warewash machine 100. From the save operation, the operation flow of the access process 500 is terminated at the second transfer operation 514. From the second transfer operation 514, the operation flow of the control process 300 is continued at the activate operation 308.

If, however, the third query operation 506 determines that the field service person has not accepted each of the determined operational settings, the operational flow passes to a second display operation 510. The second display operation 510 presents a electronic selection page to the field service person over the GUI 122 (or alternatively, a remotely connected GUI). The electronic selection page includes interface capabilities (e.g., icons, textual input prompts, etc.) that enable the field service person to modify the determined operational settings. For example, the field service person may use this selection screen to modify the setpoint from 20 to 15 units. From the second display operation 510, the operation flow passes to a second receive operation 512. The second receive operation 512 receives the modified operational settings entered by the field service person through the electronic selection page. There are various reasons for providing the field service person with such modification capabilities, and therefore these reasons are not described in detail herein. After the field service person has modified the operational settings through the electronic selection page and these modified setting have indeed been received, the operation flow passes to the save operation 508 and continues as previously described.

Figure 6:
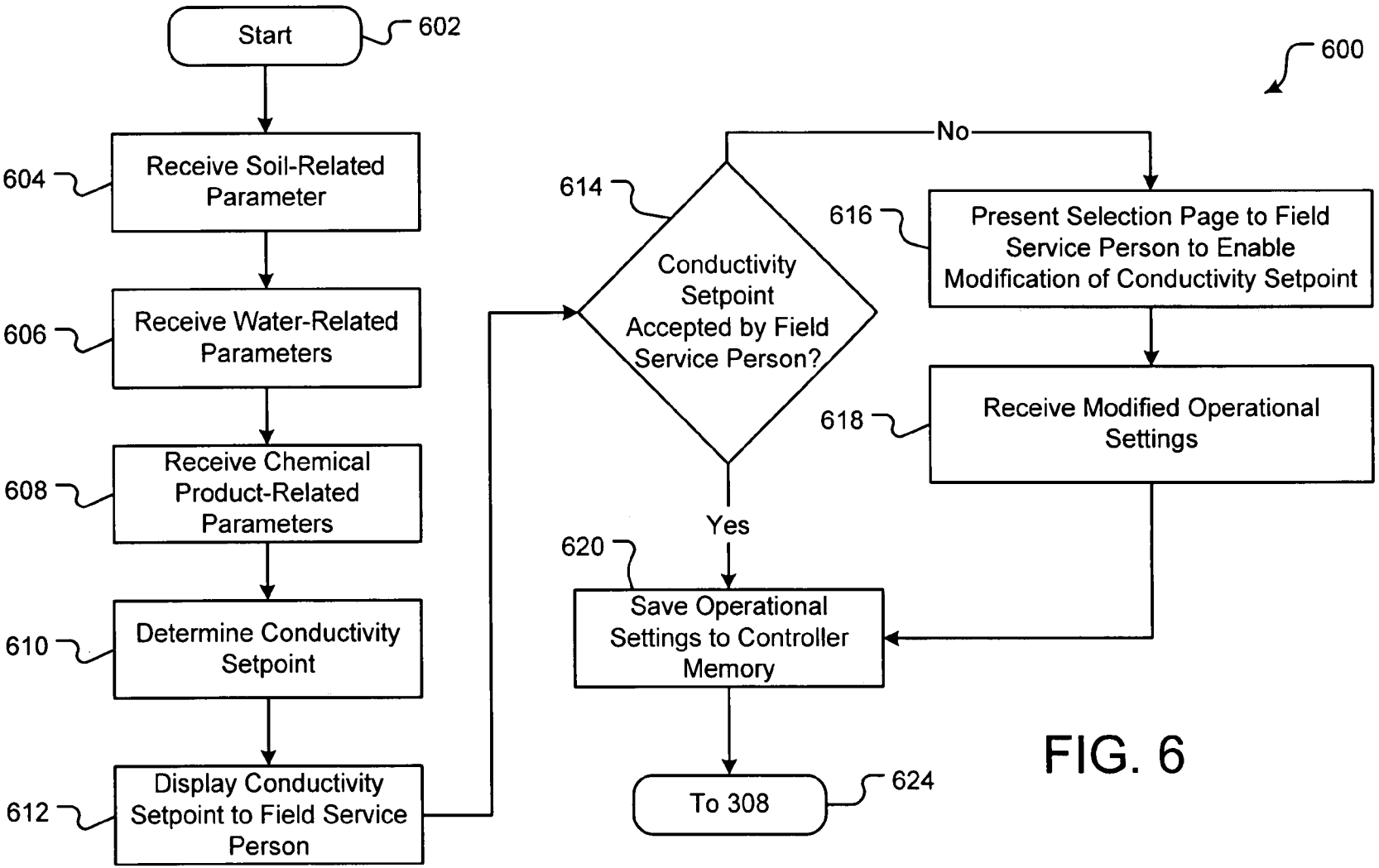
FIG. 6 is a flow diagram illustrating in more detail operations of the processes of FIGS. 3 and 5 in accordance with an exemplary embodiment of the present invention.

FIG. 6 depicts in more detail certain operations of the control process 300 and the access process 500 in an exemplary manner in order to illustrate a process 600 for defining a specific operational setting in accordance with an embodiment of the invention. More specifically, this exemplary "definition process" 600 embodies operations performed by the receive operation 304 and the analysis operation 306 in combination with all operations of the access process 500. In accordance with an exemplary embodiment, the operational setting defined by the definition process 600 is the conductivity setpoint that is used for wash processes of the warewash machine 100.

As with the control process 300 and the access process 500, the logical operations of the definition process 600 are performed by the warewash controller 112 in accordance with an embodiment of the present invention. The definition process 600 is performed by an operation flow beginning with a start operation 602 and ending with a transfer operation 624, which embodies the second transfer operation 514 described above with reference to FIG. 5. Thus, at the conclusion of the definition process 600, the operation flow of the control process 300 resumes at the activate operation 308 as described above.

The start operation 602 embodies the start operation 302, and thus, is initiated at a time when the warewash machine 100 is being installed for operation at a specific service environment. From the start operation 602, the operation flow passes sequentially to, and in no particular order, a first receive operation 604, a second receive operation 606 and a third receive operation 608, each of which is embodied in the receive operation 304 of the control process 300. Each of these receive operations (604, 606 and 608) receive a different type of environmental parameter input by the field service person through the GUI 122 (or alternatively, by a GUI implemented on a remote computer). In an embodiment, the GUI 122 presents to the field service person an electronic selection page that includes various entry elements through which these environmental parameters are entered and submitted to the warewash controller 112. After such submission, each of the receive operations (604, 606 and 608) consequently receive the associated information.

To illustrate the exemplary embodiment shown in FIG. 6, the first receive operation 604 receives a soil-related parameter corresponding to an expected, estimated or actual soil level associated with articles that will be washed by the warewash machine 100. There are many ways in which the field service person may gather this information. For example, the field service person may request that the manager of the kitchen in which the warewash machine 100 is being deployed fill out a survey inquiring about the expected servings and pre-wash processes administered by the kitchen. There exist many other ways to gather this information, and thus, it should be appreciated that any of these information gathering approaches are contemplated within the scope of the present invention. After the soil level is determined by the field service person, the field service person enters this determined soil level into the GUI 122 (or alternatively, a GUI implemented on a remote computer) and this information is consequently received by the first receive operation 604.

The second receive operation 606 of the exemplary embodiment illustrated in FIG. 6 receives a water-related parameter corresponding to the type of water that will be input to the warewash machine 100 for use in forming the rinse agent. The "type" of water is defined herein as relating to the hardness level of the water. In an embodiment, there exist the following three types of water: hard water, soft water and normal water. Whether a water type is hard, soft or normal depends on the concentration of ions and minerals within the water. As described above, it is known to those skilled in the art to measure hardness level in grains. Typically, water type varies over disperse geographic locations as well as the different water sources, e.g., well, treatment plant, river/creek bed, etc., within these locations. The field service person may use either a manual or electronic water type kit for use in measuring water on site. Electronic and manual water type kits are well-known in the art, and therefore not described in further detail herein. After the water type is detected by the field service person, the field service person enters the detected type into the GUI 122 (or alternatively, a GUI implemented on a remote computer) and this information is consequently received by the second receive operation 606.

The third receive operation 608 of the exemplary embodiment illustrated in FIG. 6 receives one or more chemical product-related parameters corresponding to the chemical product that will be input to the warewash machine 100 for use in cleaning and/or sanitizing articles placed therein. In accordance with an embodiment of the present invention, the chemical product is selected by the field service person from a plurality of possible chemical products as described in the selection process 400 of FIG. 4. Such a selection is based on one or more environmentally-associated considerations, such as, without limitation, the water type and the expected, estimated or actual soil level determined by the field service person. Moreover, the determination on which chemical product to use may depend on financial concerns of the entity employing the use of the warewash machine 100 in the service environment. After the chemical product is determined by the field service person, the field service person enters one or more parameters associated with this chemical product into the GUI 122 (or alternatively, a GUI implemented on a remote computer) and this information is consequently received by the third receive operation 608. These parameters may include, for example, the name and family of the chemical product.

Following the third receive operation 608, the operation flow passes to a determine conductivity operation 610. The determine setpoint operation 610 is an operation of the analysis operation 306 and involves the evaluation of the environmental parameters received by the first (604), second (606) and third (608) receive operations against the data structure described with reference to the control process 300 of FIG. 3. As shown in the exemplary Table 1, each set of soil level, water type and chemical product type parameters map to a specific conductivity setpoint. After determining the conductivity setpoint for the given set of received environmental parameters, the operation flow passes to a display setpoint operation 612.

The display setpoint operation 612, which is an operation of the display operation 504, presents the determined setpoint to the field service person through the GUI 122 (or alternatively, through a GUI implemented on a remote computer). The display setpoint operation 612 also presents to the field service person a selection screen through which the field service person may accept or reject the conductivity setpoint determined by the determine setpoint operation 610. From the display setpoint operation 612, the operation flow passes to a setpoint query operation 614. The setpoint query operation 614, which is an operation of the third query operation 506, determines whether the field service person has accepted or rejected the determined and displayed conductivity setpoint.

If the field service person has accepted this setpoint, the operational flow passes to a setpoint save operation 620. The save operation 620, which is an operation of the save operation 508, saves the conductivity setpoint to memory accessible by the warewash controller 112 such that the controller 112 may use the conductivity setpoint to control operation of the warewash machine 100. From the setpoint save operation 620, the operation flow passes to the transfer operation 624. From the transfer operation 624, the operation flow of the control process 300 is continued at the activate operation 308.

If, however, the setpoint query 614 determines that the field service person has not accepted the conductivity setpoint, the operational flow passes to a second display operation 616, which is an operation performed by the second display operation 510. The second display operation 616 presents an electronic selection page to the field service person over the GUI 122 (or alternatively, a remotely connected GUI). The electronic selection page includes interface capabilities (e.g., icons, textual input prompts, etc.) that enable the field service person to modify the conductivity setpoint determined by the determine setpoint operation 610. For example, the field service person may use this selection screen to modify the setpoint from 20 to 15 units. From the second display operation 616, the operation flow passes to a setpoint receive operation 618. The setpoint receive operation 618 receives the modified conductivity setpoint entered by the field service person through the electronic selection page. From the setpoint receive operation 618, the operation flow passes to the save operation 620 and continues as described above.

Figure 7:
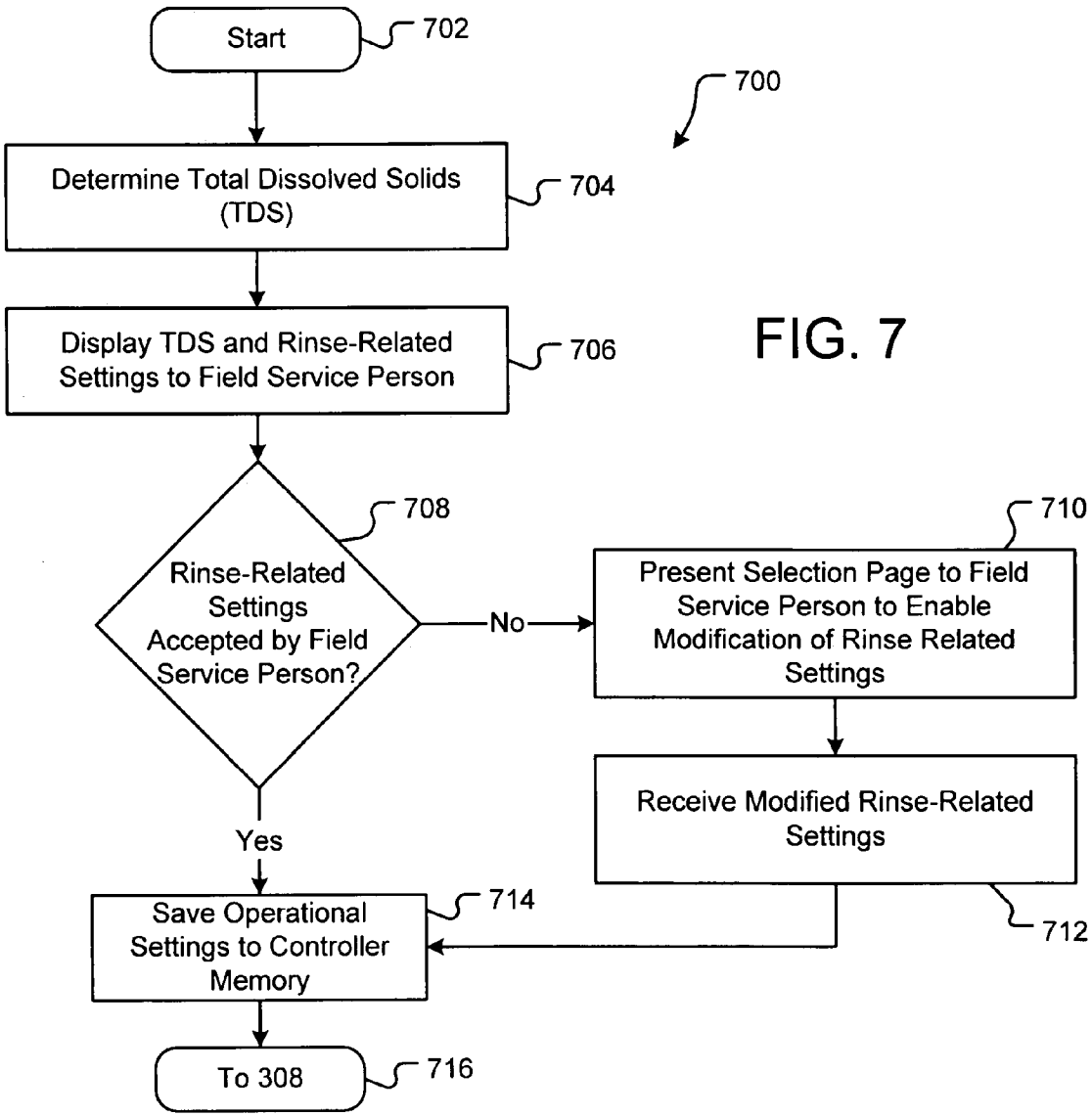
FIG. 7 is a flow diagram that illustrates operational characteristics for enabling modification of operational settings determined by the process of FIG. 6 in accordance with an embodiment of the present invention.

Turning now to FIG. 7, a process for defining rinse-related operational settings for a warewash machine 100 is shown in accordance with an embodiment of the present invention. As with the definition process 600, the "definition process" 700 is performed by an operation flow embodying various operations of the control process 300 and the access process 500. In particular, these various operations include the analysis operation 306 and all operations of the access process. When implemented, the definition process 700 provides the field service person the ability to modify specific operational settings, and in particular, the rinse-related settings, prior to initiating activation of the warewash machine 100 in the service environment. As with the definition process 600, the logical operations of the definition process 700 are performed by the warewash controller 112 in accordance with an embodiment of the present invention.

The operation flow of the definition process 700 begins at a start operation 702 and concludes at a transfer operation 716. The start operation 702 embodies the start operation 302, and thus, is initiated at a time when the warewash machine 100 is being installed at a specific service environment. The transfer operation 716 connects the definition process 700 with the control process 300 at the activate operation 308. From the start operation 702, the operation flow passes to a TDS determination operation 704.

The TDS determination operation 704 determines the total dissolved solids (TDS) associated with the chemical solution. TDS is a measurement associated with an inherent conductivity of water used as or to form the rinse agent used by the warewash machine 100. As such, prior to determining the TDS, the TDS determination operation 704 must have knowledge of the inherent conductivity of the water being used by the warewash machine 100. In an embodiment, this inherent conductivity is stored in memory as an offset value ("conductivity offset") and used by the warewash controller to control dispensing of chemical product and/or rinse agent into the warewash machine 100.

The inherent conductivity of water varies based on geography and water source as does the type of water. One method that may be used to calculate the conductivity offset associated with water is to sample the water while situated in the solution storage tank 140 prior to introducing any chemical product therein. This sample is taken by the conductivity probe 138 and transmitted to the warewash controller 112. The warewash controller 112 determines the conductivity of the water using information derived from the sample. Multiple samples may be taken in order to ensure that the determined offset is accurate. It will be understood by those skilled in the art that this offset determination process is preferably administered at some time during the installation of the warewash machine 100.

In an embodiment, the TDS is determined by multiplying the determined offset by a multiplier. Other methods for determining the TDS from a determined offset are known in the art and contemplated within the scope of the present invention. After the TDS is determined, the operation flow passes to a first display operation 706. The first display operation 706 presents the determined TDS and rinse-related parameters determined by the analysis operation 306 to the field service person through the GUI 122 (or alternatively, a GUI implemented on a remote computer). Exemplary rinse-related parameters include, without limitation, a cycle time in which rinse agent is dispensed during the rinse cycle, the amount of rinse agent that is to be dispensed during each rinse cycle, the amount of additive that is to be added to the water to form the rinse agent and various other operational settings pertaining to rinse cycles.

The first display operation 706 also presents to the field service person a selection screen through which the field service person may accept or reject the rinse-related parameters determined by the analysis operation 706. From the first display operation 706, the operation flow passes to a first query operation 708. The first query operation 708, which is an operation of the third query operation 506, determines whether the field service person has accepted or rejected the determined and displayed rinse-related parameters. In an embodiment described herein, the field service person makes such a determination based on the TDS. That is, the field service person may decide to modify certain rinse-related parameters based on his/her knowledge of the determined TDS.

If the field service person accepts the rinse-related settings, the operational flow passes to a save operation 714. The save operation 714, which is an operation of the save operation 508, saves the rinse-related parameters to memory accessible by the warewash controller 112 such that the controller 112 may use these settings to control operation of the warewash machine 100. From the save operation 714, the operation flow passes to the transfer operation 716, which initiates the operation flow of the control process 300 at the activate operation 308.

If, however, the first query operation 708 determines that the field service person has not accepted the displayed rinse-related settings, the operational flow passes to a second display operation 710, which is an operation performed by the second display operation 510. The second display operation 710 presents an electronic selection page to the field service person over the GUI 122 (or alternatively, a remotely connected GUI). The electronic selection page includes interface capabilities (e.g., icons, textual input prompts, etc.) that enable the field service person to modify the rinse-related settings displayed on the GUI 122. For example, the field service person may use this selection screen to modify the amount of rinse agent applied to articles from 20 drops to 30 drops if the TDS warrants such an increase in rinse agent application. From the second display operation 710, the operation flow passes to a receive operation 712. The receive operation 712 receives the modified rinse-related settings entered by the field service person through the electronic selection page. From the receive operation 712, the operation flow passes to the save operation 714 and continues as described above.

It will be clear that the present invention is well adapted to attain the ends and advantages mentioned, as well as those inherent therein. While a presently preferred embodiment has been described for purposes of this disclosure, various changes and modifications may be made which are well within the scope of the present invention. For example, the utility device described herein to illustrate the present invention is a warewash machine 100. However, the present invention may also be utilized with various other types of utility devices, such as, and without limitation, a laundry machine. Additionally, the warewash controller 112 is illustrated as being a "smart" controller that is operable to control all operations of the warewash machine 100, including the rinse module 102 and the wash module 104. Alternatively, a separate controller may be used to control operation of the rinse module 102 and the wash module 104.

Figure 8:
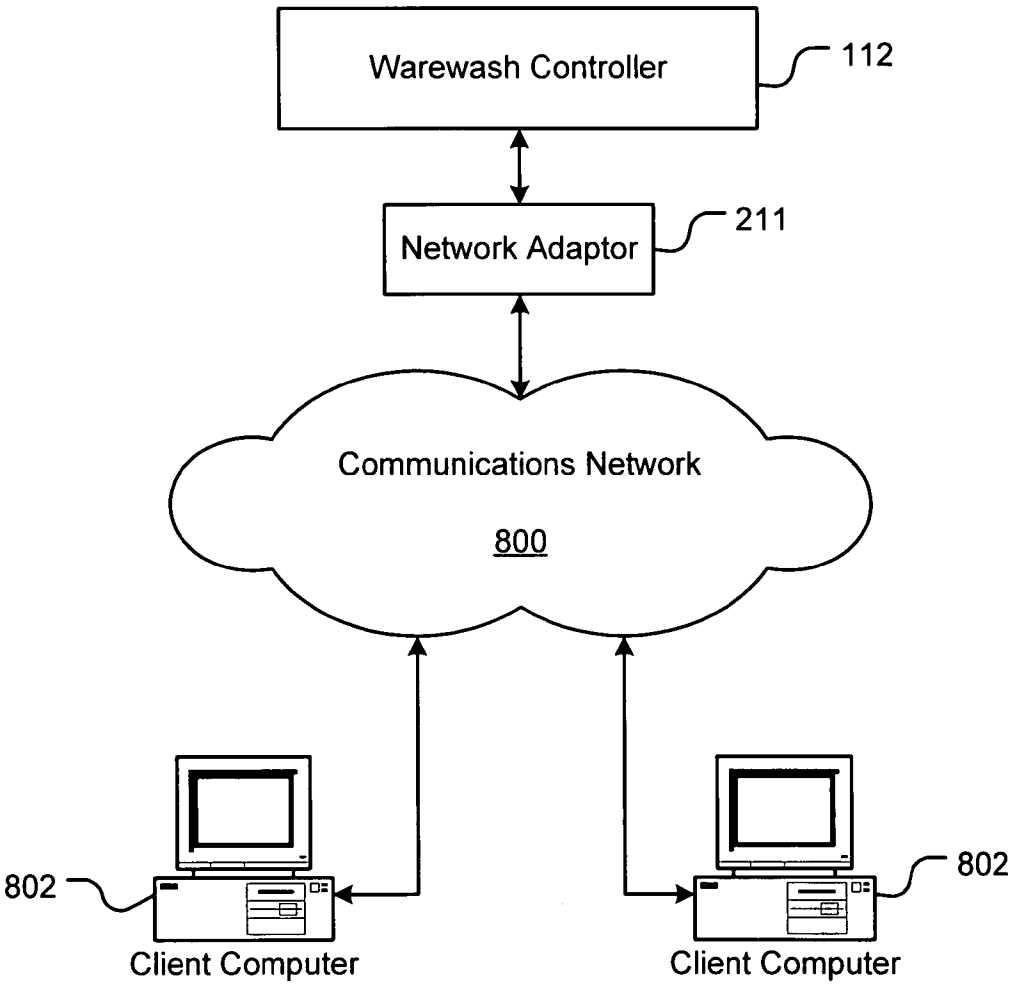
FIG. 8 depicts a network environment in which the present invention may be implemented in accordance with an embodiment of the present invention.

Further, the warewash controller 112 may connect to a communications network 800 by way of a network interface, such as the network adapter 211 shown in FIG. 2. Such an embodiment is shown in FIG. 8. Through this network connection, the controller 112 is operable to transmit information to one or more remote computers, such as, without limitation, a server computer or user terminals. Various types of information may be transmitted from the controller 112 to these remote computers over the network connection including, without limitation, the various environmental and operational settings described herein. In addition, the network adaptor 211 enables users at remote computers the ability to issue commands to the controller 112. For example, a user at a remote computer may modify the conductivity setpoint using this network connection.

Additionally, the selection screens presented to users through the GUI 122 may also enable a user to define various other operational settings-other than the parameters described above. Such other parameters may include, without limitation, the amount of time for a wash cycle, the amount of time that the wash module 106 is active, the amount of time that the rinse module 102 is active, a temperature for the rinse agent, a rate at which conductivity is sensed, or monitored, by the inductive probe 138 operating in conjunction with the warewash controller 112, a rate in which a chemical product is dispensed if the warewashing operations are time-based, e.g., in implementations where the warewash controller 112 does not control dispensing based on information sensed by the inductive probe 138, a rate in which water is dispensed, and velocity of the revolution of wash and rinse arms about a spindle axis.

Numerous other changes may be made which will readily suggest themselves to those skilled in the art and which are encompassed in the spirit of the invention disclosed and as defined in the appended claims.

What is claimed is:

1. In a computer system, a method for configuring a utility device to perform a service at a service environment, wherein the service performed by the utility device comprises application of a chemical solution to articles, the chemical solution being formed by combining a rinse agent and a chemical product in a solution tank, the method comprising:

providing a graphical user interface through which a field service person inputs one or more parameters associated with the service environment;

receiving through the graphical user interface a first parameter relating to a soil level on the articles;

receiving through the graphical user interface a second parameter relating to a specific type of water used to form the rinse agent;

receiving through the graphical user interface a third parameter identifying the chemical product;

analyzing the one or more parameters to determine operational settings for use by the utility device in performing the service, wherein the analyzing act comprises evaluating the first parameter, the second parameter and the third parameter to determine a conductivity setpoint for the chemical solution, wherein the conductivity setpoint is one of the set of operational settings and wherein the conductivity setpoint defines a target percent concentration of the chemical product within the chemical solution;

receiving through the graphical user interface an indication to activate the utility device to perform the service at the service environment; and in response to the indication, controlling operation of the utility device based on the operational settings determined by the analyzing act, wherein the controlling act comprises:

detecting a current conductivity of the chemical solution in the solution tank; and dispensing a predetermined amount of the chemical product to the solution tank in response to the current conductivity falling below the conductivity setpoint, wherein the predetermined amount of the chemical product is an operational setting determined by analyzing the first parameter, the second parameter and the third parameter against a data structure mapping the operational settings to a plurality of parameter groupings, wherein the first parameter, the second parameter and the third parameter form one of the plurality of parameter groupings.

2. A method as defined in claim 1, wherein the utility device is a warewash machine.

3. A method as defined in claim 1, further comprising:

displaying on the graphical user interface the conductivity setpoint determined by the evaluating act; and presenting on the graphical user interface an electronic selection screen comprising an interface element for modifying the conductivity setpoint.

4. A method as defined in claim 3, wherein the controlling act further comprises:

in response to modification of the conductivity setpoint via the interface element, controlling operation of the utility device based on the modified conductivity setpoint.

5. A method as defined in claim 1, wherein the graphical user interface is presented to the field service person on a display device coupled to computer system.

6. A method as defined in claim 1 wherein the graphical user interface is presented to the field service person on a display device coupled to a client computer communicatively connected to the computer system.

7. A method as defined in claim 1, wherein the service comprises performance of a process using a combination of a chemical product and water, the method further comprising:

defining a plurality of candidate chemical products that may be used in the performance of the process at the service environment;

determining a hardness level associated with the water; and analyzing the hardness level against each of the plurality of candidate chemical products to select therefrom the chemical product, wherein the selected chemical product is one of the one or more parameters input by the field service person through the graphical user interface.

8. A computer program product readable by a computer system and tangibly embodying a program of instructions executable by the computer system to perform the method of claim 1.

9. In a computer system, a method for configuring a utility device to perform a service at a service environment, wherein the service comprises performance of a process using a combination of a chemical product and water, the method comprising:

providing a graphical user interface through which a field service person inputs one or more parameters associated with the service environment;

analyzing the one or more parameters to determine operational settings for use by the utility device in performing the service;

defining a plurality of candidate chemical products that may be used in the performance of the process at the service environment;

determining a hardness level associated with the water; and analyzing the hardness level against each of the plurality of candidate chemical products to select therefrom the chemical product, wherein the selected chemical product is one of the one or more parameters input by the field service person through the graphical user interface;

evaluating a specified consideration to render therefrom a first parameter value indicative of results derived from examination of the specified consideration, wherein the analyzing act analyzes both the hardness level and the first parameter value against each of the plurality of candidate chemical products to administer the selection of the chemical product;

receiving through the graphical user interface an indication to activate the utility device to perform the service at the service environment; and in response to the indication, controlling operation of the utility device based on the operational settings determined by the analyzing act.

10. A method as defined in claim 9, wherein the first parameter value relates to an average level of soil that will be washed from articles by the utility device as a result of performance of the process.

11. A method as defined in claim 10, wherein the utility device is a warewash machine.

12. A method as defined in claim 10, wherein the utility device is a laundry machine.

13. A computer program product readable by a computer system and tangibly embodying a program of instructions executable by the computer system to perform the method of claim 9.

14. A computer-implemented method for configuring a utility device to perform a service at a service environment, wherein the service performed by the utility device comprises application of a chemical solution to articles, the chemical solution being formed by combining a rinse agent and a chemical product in a solution tank, the method comprising:

providing a graphical user interface through which a field service person inputs one or more parameters associated with the service environment;

receiving through the graphical user interface a first parameter relating to a soil level on the articles;

receiving through the graphical user interface a second parameter relating to a specific type of water used to form the rinse agent; and receiving through the graphical user interface a third parameter identifying the chemical product;

analyzing the one or more parameters to determine a set of operational settings for use by the utility device in performing the service, wherein the analyzing act comprises:

evaluating the first parameter, the second parameter and the third parameter to determine a conductivity setpoint for the chemical solution, wherein the conductivity setpoint is one of the set of operational settings and wherein the conductivity setpoint defines a target percent concentration of the chemical product within the chemical solution;

saving the set of operational settings to memory for use in controlling operation of the utility device during performance of the service;

receiving through the graphical user interface an indication to activate the utility device to perform the service at the service environment;

in response to the indication, controlling operation of the utility device based on the set of operational settings saved to memory, wherein the controlling act comprises:

detecting a current conductivity of the chemical solution in the solution tank; and dispensing a predetermined amount of the chemical product to the solution tank in response to the current conductivity falling below the conductivity setpoint, wherein the predetermined amount of the chemical product is an operational setting determined by analyzing the first parameter, the second parameter and the third parameter against a data structure mapping each of the set of operational settings to a plurality of parameter groupings, wherein the first parameter, the second parameter and the third parameter form one of the plurality of parameter groupings;

displaying on the graphical user interface the set of operational settings determined by the analyzing act;

presenting on the graphical user interface an electronic selection screen comprising an interface element for modifying at least one of the set of operational settings; and in response to modification of an operational setting, updating the set of operational settings to include the modified operational setting.

15. A method as defined in claim 14, wherein the utility device is a warewash machine.

16. A computer-implemented method for configuring a utility device to perform a service at a service environment, wherein the service performed by the utility device comprises application of a chemical solution to articles, the chemical solution being formed by combining a rinse agent and a chemical product in a solution tank, the method comprising:

providing a graphical user interface through which a field service person inputs one or more parameters associated with the service environment;

receiving through the graphical user interface a first parameter relating to a soil level on the articles;

receiving through the graphical user interface a second parameter relating to a specific type of water used to form the rinse agent; and receiving through the graphical user interface a third parameter identifying the chemical product;

analyzing the one or more parameters to determine a set of operational settings for use by the utility device in performing the service, wherein the analyzing act comprises:

evaluating the first parameter, the second parameter and the third parameter to determine a conductivity setpoint for the chemical solution, wherein the conductivity setpoint is one of the set of operational settings and wherein the conductivity setpoint defines a target percent concentration of the chemical product within the chemical solution;

saving the set of operational settings to memory for use in controlling operation of the utility device during performance of the service;

receiving through the graphical user interface an indication to activate the utility device to perform the service at the service environment;

in response to the indication, controlling operation of the utility device based on the set of operational settings saved to memory, wherein the controlling act comprises:

detecting a current conductivity of the chemical solution in the solution tank, and dispensing a predetermined amount of the chemical product to the solution tank in response to the current conductivity falling below the conductivity setpoint;

displaying on the graphical user interface the set of operational settings determined by the analyzing act;

presenting on the graphical user interface an electronic selection screen comprising an interface element for modifying at least one of the set of operational settings, wherein the interface element is operable to modify the conductivity setpoint; and in response to modification of an operational setting, updating the set of operational settings to include the modified operational setting, wherein the updating act comprises:

in response to modification of the conductivity setpoint via the interface element, updating the set of operational settings to include the modified conductivity setpoint.

17. A method as defined in claim 16, wherein the controlling act further comprises:

controlling operation of the utility device based on the modified conductivity setpoint.

18. A computer-implemented method for configuring a utility device to perform a service at a service environment, the method comprising:

providing a graphical user interface through which a field service person inputs one or more parameters associated with the service environment;

analyzing the one or more parameters to determine a set of operational settings for use by the utility device in performing the service, wherein the analyzing act comprises:

determining a conductivity offset relating to an inherent conductivity of a rinse agent; and utilizing the conductivity offset to determine a total dissolved solids parameter for a chemical solution, wherein the displaying act displays the total dissolved solids parameter on the graphical user interface in conjunction with one or more operational settings related to a rinse cycle performed by the utility device to apply the rinse agent to articles during the service;

saving the set of operational settings to memory for use in controlling operation of the utility device during performance of the service;

displaying on the graphical user interface the set of operational settings determined by the analyzing act;

presenting on the graphical user interface an electronic selection screen comprising an interface element for modifying at least one of the set of operational settings; and in response to modification of an operational setting, updating the set of operational settings to include the modified operational setting.

19. A method as defined in claim 18, wherein the interface element is operable to modify the at least one of the one or more operational settings related to the rinse cycle.

20. A method as defined in claim 19 wherein the utility device is a warewash machine.

21. A computer program product readable by a computer system and tangibly embodying a program of instructions executable by the computer system to perform the method of claim 18.

22. A computer program product as defined in claim 21, wherein the computer program product is a communications medium.

* * * * *